US005995070A

United States Patent [19]

Kitada

[11] Patent Number: 5,995,070

[45] Date of Patent: Nov. 30, 1999

[54] LED DISPLAY APPARATUS AND LED DISPLAYING METHOD

[75] Inventor: Takashi Kitada, Ogori, Japan

[73] Assignee: Matsushita Electric Industrial Co., Ltd., Osaka, Japan

[21] Appl. No.: 08/861,533

[22] Filed: May 22, 1997

[30] Foreign Application Priority Data

May 27, 1996 [JP] Japan ..... 8-131525

[51] Int. Cl.[6] ..... G09G 3/32

[52] U.S. Cl. ..... 345/83

[58] Field of Search ..... 345/83, 102, 82, 345/515, 516; 379/61; 348/468

[56] References Cited

U.S. PATENT DOCUMENTS 5,426,446 6/1995 Takei et al. ..... 345/83
5,477,274 12/1995 Akiyoshi et al. ..... 348/468
5,668,568 9/1997 Holloman ..... 345/83
5,677,944 10/1997 Yamamoto et al. ..... 379/61
5,724,062 3/1998 Hunter ..... 345/102
5,767,837 6/1998 Hara ..... 345/83

*Primary Examiner*—Richard A. Hjerpe
*Assistant Examiner*—Ronald Leneau
*Attorney, Agent, or Firm*—Stevens, Davis, Miller & Mosher, L.L.P.

[57] ABSTRACT

Image display apparatus and method with an LED matrix device. Each dot of the device is composed of one red LED, one blue LED and two green LEDs. When data displayed in a 16×16 dot matrix is displayed by reducing the data to a 8×8 dot matrix, 2×2 dots of the 16×16 matrix are grouped into one unit composed of 2×2 dots arrayed in a matrix. Four data, i.e., data obtained by extracting upper-left data from all the units, data obtained by extracting upper-right data, data obtained by extracting lower-left data, data obtained by extracting lower-right data, respectively, from all the dot units, are successively displayed on a time division basis with deviation corresponding to a half dot relative to one another. Image of smooth contour can be generated even with a small-scale LED display apparatus having a small number of dots and low resolution.

12 Claims, 17 Drawing Sheets

UPPER-LEFT DATA

UPPER-RIGHT DATA

LOWER-LEFT DATA

LOWER-RIGHT DATA

LED DRIVING PATTERN FOR UPPER-LEFT DATA DISPLAY

LED DRIVING PATTERN FOR UPPER-RIGHT DATA DISPLAY

LED DRIVING PATTERN FOR LOWER-LEFT DATA DISPLAY

LED DRIVING PATTERN FOR LOWER-RIGHT DATA DISPLAY

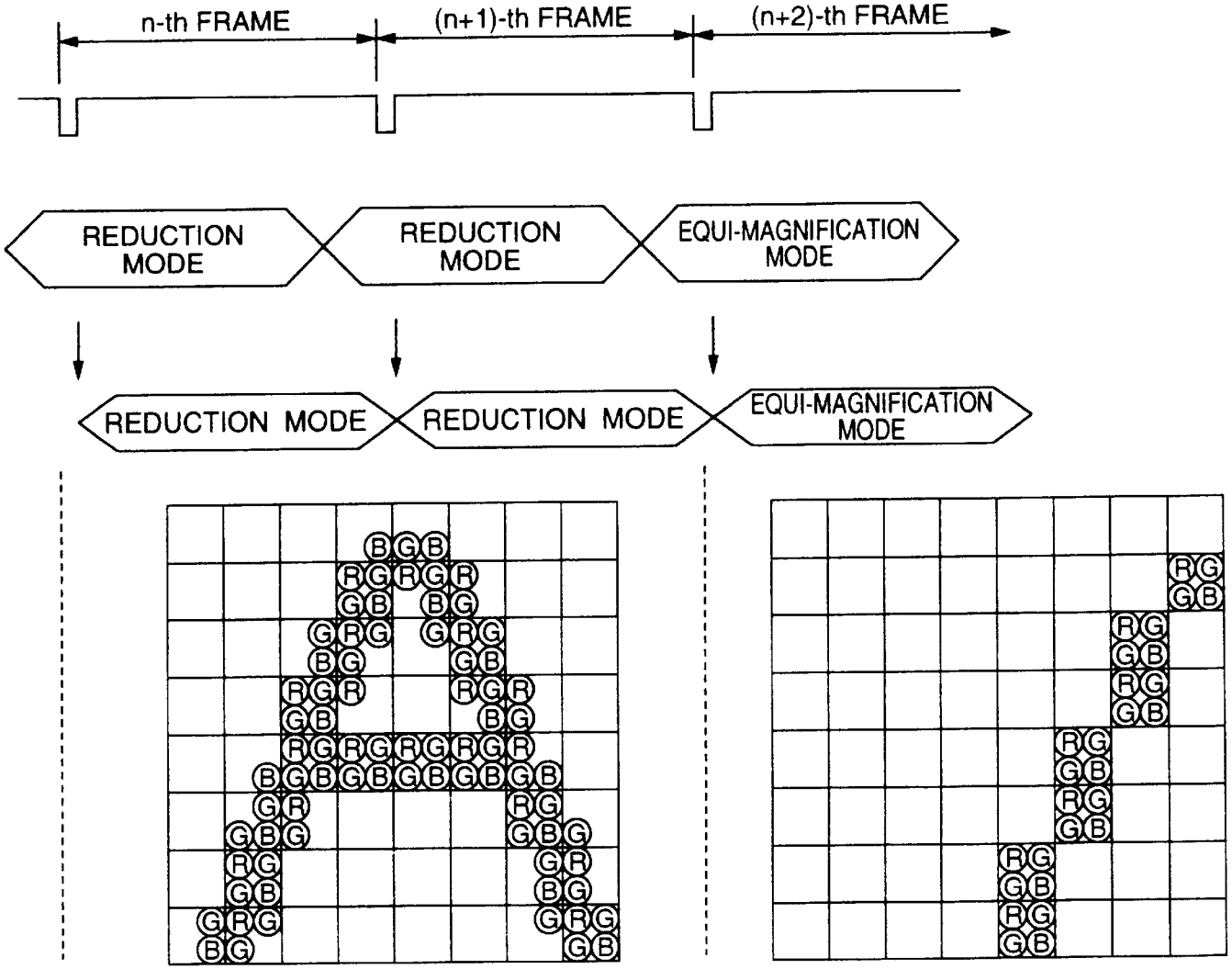
FIG.12A SYNCHRONIZING SIGNAL b
FIG.12B DISPLAY CHANG-OVER SIGNAL CH
FIG.12C SAMPLING TIMING
FIG.12D DISPLAY MODE
FIG.12E DISPLAY CONTENTS

INPUT DISPLAY DATA

AVERAGING DATA

UPPER-LEFT DATA

UPPER-RIGHT DATA

LOWER-LEFT DATA

LOWER-RIGHT DATA

LED DISPLAY APPARATUS AND LED DISPLAYING METHOD

BACKGROUND OF THE INVENTION

1. Field of the Invention

The present invention relates to an LED display apparatus and an LED displaying method capable of displaying color pictures of high quality by using a dot-matrix type LED display device having a relatively small number of dots and low resolution.

2. Description of Related Art

With the advent of LED (Light Emission Diode) capable of emitting blue light rays with high intensity or luminance, there have been developed in recent years full-color LED display devices or apparatus of a large size which can realize high visibility even in the open air. In practical applications, the full-color LED display apparatus began to be used for displaying pictures and information not only in sports fields and recreation grounds but also for outdoor and indoor advertisements.

For facilitating understanding of the concept underlying the invention, technical background thereof will first be described. FIG. 17 of the accompanying drawings is a block diagram showing a conventional LED display apparatus 1 known heretofore. Referring to the figure, a dot-matrix type LED display device or unit 2 includes a plurality of LEDs (8×8=64 LEDs in the device shown in FIG. 17) arrayed in the form of a dot matrix. A display data receiver 3 receives display data (i.e., data to be displayed) a from a display signal generation source such as a personal computer or the like (not shown) under the timing determined by a synchronizing signal b. A display data storage unit 4 serves for storing the display data a received by the display data receiver 3. On the other hand, the display data a stored in the display data storage unit 4 are read out by a display data read-out unit 5. A counter 8 counts a clock signal CK which provides a source for various timing signals. A comparison unit 9 compares the display data a read out from the display data read-out unit 5 with a count value outputted from the counter 8. A light emission driver control unit 10 outputs signals for controlling light emission driver circuits 11, 12 and 13 on the basis of an output signal of the comparison unit 9, wherein the light emission driver circuits 11, 12 and 13 drive relevant LEDs of the dot-matrix type LED display device 2, which will be described in more detail later on.

Next, description will be directed to the operations of the LED display apparatus 1 implemented in the structure described above. The display data a supplied from the display signal generation source are received by the display data receiver 3 under the timing given by the synchronizing signal b. The display data a as received are temporarily stored in the display data storage unit 4. The display data a stored in the display data storage unit 4 are read out by the display data read-out unit 5 under the timing of a timing signal t generated on the basis of the synchronizing signal b and supplied to the comparison unit 9 to be set therein.

On the other hand, the counter 8 starts to count the clock signal CK. The count value of the clock signal CK is compared with the display data a set at the comparison unit 9. In this conjunction, assume, only by way of example, that the number of the display data a set at the comparison unit 9 is "128". In that case, so long as the count value is smaller than "128" inclusive, the comparison unit 9 outputs a light emission enable signal (e.g. H-level signal) for enabling light emission of the LED. On the contrary, when the count value exceeds "128", the comparison unit 9 outputs a light emission inhibit signal (e.g. L-level signal) for disabling or inhibiting the light emission of the LED. In response to the output signal from the comparison unit 9, the light emission driver control unit 10 outputs a signal for controlling the light emission driver circuits 11, 12 and 13 for the relevant LEDs of the dot-matrix type LED display device 2.

In this manner, in the conventional LED display apparatus, the time for light emission of each of the LEDs is controlled on the basis of the display data a, which in turn means that display with gradation corresponding to the display data a can be realized. Thus, the LED display apparatus can generate not only character images but also motion picture images including various natural pictures. At this juncture, it should be mentioned that there are provided usually a plurality of comparison units 9 in correspondence to various LED blocks, although only one comparison unit 9 is shown. The same holds true in the following description as well.

However, when the conventional LED display apparatus is operated by using the personal computer as the display signal generation source for displaying on the dot-matrix type LED display device 2 the same contents as those displayed on the monitor of the personal computer, there arises a problem that difficulty is encountered in implementing such LED display apparatus at low cost, because an extremely large number of LEDs (e.g. 640×480 for each of red, blue and green displays in the case of color display) is required in order to meet the VGA (video graphics array) specifications for the personal computer.

This problem will be elucidated more concretely by taking as an example the display of character data by the conventional LED display apparatus. FIG. 18A of the accompanying drawings illustrates, only by way of example, display of an upper case alphabetic character "A" on the dot-matrix type LED display device 2 including an array of 16×16 dots. The display data a inputted from the display signal generation source such as the personal computer is composed of 16×16 dots on a frame-by-frame basis as illustrated in FIG. 18A, wherein each dot is represented by one red LED (R) (red light emission diode), one blue LED (B) and two green LEDs (G). In FIG. 18A, the dots designated by R, G and B each in a circle indicate that the corresponding LEDs are lit while the dots which are not labeled with R, G and B are not lit.

By contrast, FIG. 18B is a view for illustrating a corresponding image generated for the 16×16 display data inputted to the display data receiver 3 by processing the data such that 4 (2×2) dots are converted into one unit, whereon the four dot data contained in each of the units are averaged so as to constitute or represent one dot. The image shown in FIG. 18B is generated on the basis of the averaged data by selectively driving the relevant LEDs of the 8×8 dot-matrix type LED display device 2. From the comparison of the image shown in FIG. 18B with that of FIG. 18A, it can be seen that the image generated on the basis of the averaged display data shown in FIG. 18B is accompanied with rougher contours and thus remarkably degraded in respect to the resolution when compared with the image shown in FIG. 18A.

In the LED display apparatuses developed in recent years, it is demanded that color display of high quality or high definition should be able to be generated even with a dot-matrix type LED display unit composed of a small number of dots and exhibiting low resolution.

SUMMARY OF THE INVENTION

In the light of the state of the art described above, it is an object of the present invention to provide an LED display apparatus which is capable of generating color images or pictures of high quality notwithstanding of a small number of dots and low resolution of the apparatus.

Another object of the present invention is to provide an LED-device oriented displaying method which makes it possible to generate color displays of high quality with a LED display apparatus having a small number of dots and low resolution.

In the LED display apparatus according to the present invention, display data (i.e., data to be displayed) a of 16×16 dots each to be displayed by red, blue and green LEDs (shown in FIGS. 2A and 2B) are divided or grouped into 64 (=8×8) units la each composed of a predetermined number of dots (2×2 dots) for each color.

Subsequently, only the upper-left data of one unit (shown in FIG. 2B) is extracted from all the units and arrayed in a matrix of 8×8 dots (shown in FIG. 3A). Thereafter, upper-right data, lower-left data and the lower-right data are sequentially extracted and arrayed in similar manners, respectively, (FIGS. 3B, 3C and 3D).

Upon completion of the processing for the upper-left data (FIG. 3A), then the upper-right data is processed. In that case, the display data read out is a group of the display data (upper-right data) located at the upper-right position in each of the units which result from division of the display data a of 16×16 dots for each color of red, blue and green (FIG. 2A) into 64 (=8×8) units 1*a* each constituted by 2×2 dots on a color-by-color basis.

In succession to extraction of the data from the upper-left, upper-right, lower-left and lower-right data groups through the processing procedure described above, then the upper-left data group, the upper-right data group, the lower-left data group and the lower-right data group are sequentially displayed in this order on a time-division basis. The display in this case is realized by deviating each data group by one LED (i.e., by a half dot).

More specifically, when the LEDs constituting the dots for which the data exist are lit for a predetermined time period for displaying the upper-left data (FIG. 3A), then the red LED (R) corresponding to the upper-left portion of the dot located at the first row and first column in the upper-left data (FIG. 3B) is displayed for a predetermine time period in superposition to the green LED (G) corresponding to the upper-right portion of the dot located at the first row and first column (FIG. 3A).

Similarly, when the lower-left data (FIG. 3C) is displayed, the red LED (R) corresponding to the upper-left portion of the dot positioned at the first row and first column (FIG. 3C) is displayed for a predetermine time period in superposition to the green LED (G) corresponding to the lower-left portion of the dot located at the first row and first column (FIG. 3A). On the other hand, when the lower-right data (FIG. 3D) is displayed, the red LED (R) corresponding to the upper-left portion of the dot positioned at the first row and first column in the data shown in FIG. 3D is displayed for a predetermine time period in superposition to the blue LED (B) corresponding to the lower-right portion of the dot located at the first row and first column (FIG. 3A).

In this manner, the four data groups are displayed for all the dots successively on a time-division basis with deviation of a half dot to one another. A series of operations required for the display mentioned above is defined as one cycle as shown in FIGS. 5A, 5B. By repeating such cycle a number of times for one and the same frame for the purpose of suppressing flicker, there can be displayed an image improved in respect to contour as shown in FIG. 6A.

Thus, according to a general aspect of the invention, there is provided an LED display apparatus which includes a display data receiver for receiving input display data, a display data storage unit for storing the input display data received by the display data receiver, a display data read-out unit for reading out parts of the input display data belonging to a same frame from the display data storage unit a predetermined number of times by grouping the predetermined number of dots of the input display data belonging to the same frame into one unit to be read out in one cycle, a read-out operation counting unit for counting a number of times the parts of the input display data belonging to the same frame is read out by the display data read-out unit, an address determining unit for determining read-out address for each of the predetermined number of dots in the display data read-out unit in accordance with the above-mentioned number of times, and a light emission driver control unit for controlling light emission driver designed for driving corresponding groups of LEDs incorporated in a dot-matrix type LED display device on the basis of a portion of the input display data read out by the display data read-out unit. With the arrangement of the LED display apparatus described above, it is possible to generate a color display of high quality even with the dot-matrix type LED display device having a small number of dots and low resolution by virtue of such arrangement that a predetermined number of dots of the input display data belonging to a same frame are grouped to one data unit, whereon the data units thus generated and smaller in number than the dots of the input display data are processed for the display of the input data.

In a preferred mode for implementing the LED display apparatus, there may further be provided a display change-over unit for controlling an address determining method to be adopted in the address determining unit on the basis of a display mode. Owing to this arrangement, the data can be displayed on the dot-matrix type LED display device in conformance with the display mode as determined.

In another preferred mode for carrying out the invention, the display change-over unit may preferably be so designed as to sample a display change-over signal indicating a display mode on a frame-by-frame basis. Owing to the arrangement mentioned above, there can be obtained advantageous effect that the display is generated on the dot-matrix type LED display device in conformance with the display mode.

According to another general aspect of the invention, there is provided an LED display apparatus which includes a display data receiver for receiving input display data, an averaging unit for generating averaged data from the input display data received by the display data receiver by averaging the input display data for every first predetermined number of dots, a display data storage unit for storing the averaged data, a display data read-out unit for reading out parts of the averaged data belonging to a same frame from the display data storage unit a second predetermined number of times by grouping the second predetermined number of dots of the input display data belonging to the same frame into one unit to be read out in one cycle, a read-out operation counting unit for counting a number of times the parts of the averaged data belonging to the same frame is read out by the display data read-out unit, an address determining unit for determining read-out address for each of the second predetermined number of dots in the display data read-out unit in accordance with the number of times, and a light emission driver control unit for controlling light emission driver designed for driving corresponding groups of LEDs incorporated in a dot-matrix type LED display device on the basis of a portion of the averaged data read out by the display data read-out unit. By virtue of the arrangement of the LED display apparatus described above, the display generated on the dot-matrix type LED display device can be simplified by a factor corresponding to a product of the first predetermined number and the second predetermined number.

The concept of the invention can equally be realized as a method of displaying data with a dot-matrix type LED display device. Thus, according to a further aspect of the invention, there is provided a method of displaying data with a dot-matrix type LED display device, which method includes a display data receiving step of receiving input display data, a display data storing step of storing the input display data as received, a display data read-out step of reading out parts of the input display data belonging to a same frame a predetermined number of times by grouping the predetermined number of dots of the input display data belonging to the same frame into one unit to be read out in one cycle, a read-out operation counting step of counting a number of times the parts of the input display data belonging to the same frame is read out, an address determining step of determining read-out address for each of the predetermined number of dots in accordance with the number of times, and a light emission driver control step of controlling light emission driver designed for driving corresponding groups of LEDs incorporated in the dot-matrix type LED display device on the basis of a portion of the input display data read out by the display data read-out unit. The method mentioned above is advantageous in that a color display of high quality can be generated even with a dot-matrix type LED display device having a small number of dots and low resolution by virtue of such arrangement that a predetermined number of dots of the input display data belonging to a same frame are grouped to one data unit, whereon the data units thus generated and smaller in number than the dots of the input display data are processed for the display of the input data.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 12A is a timing chart for illustrating a synchronizing signal;

FIG. 12B is a timing chart for illustrating display modes indicated by a display change-over signal;

FIG. 12C is a timing chart showing sampling time points;

FIG. 12D is a timing chart for illustrating display modes set by a display change-over unit;

FIG. 12E is a diagram for illustrating contents of displays generated on a dot-matrix type LED display device;

DESCRIPTION OF THE PREFERRED EMBODIMENTS

Figure 1:
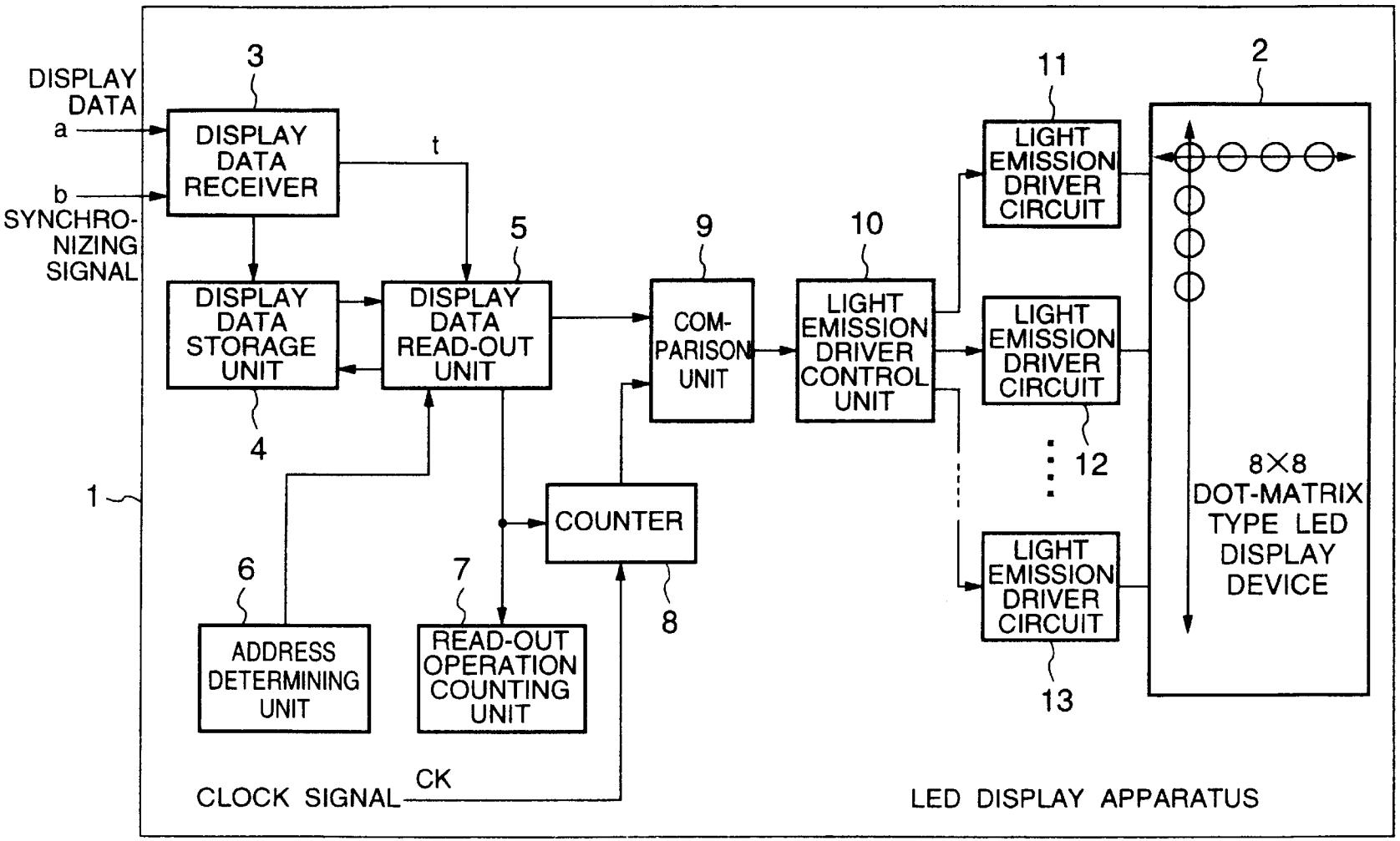
FIG. 1 is a block diagram showing a configuration of an LED display apparatus according to a first embodiment of the present invention.

Now, the present invention will be described in detail in conjunction with what is presently considered as preferred or typical embodiments thereof by reference to the drawings. In the following description, like reference characters designate like or corresponding parts throughout the several views. Also in the following description, it is to be understood that such terms as "left", "right", "upper", "lower" and the like are words of convenience and are not to be construed as limiting terms.

Embodiment 1

Figure 17:
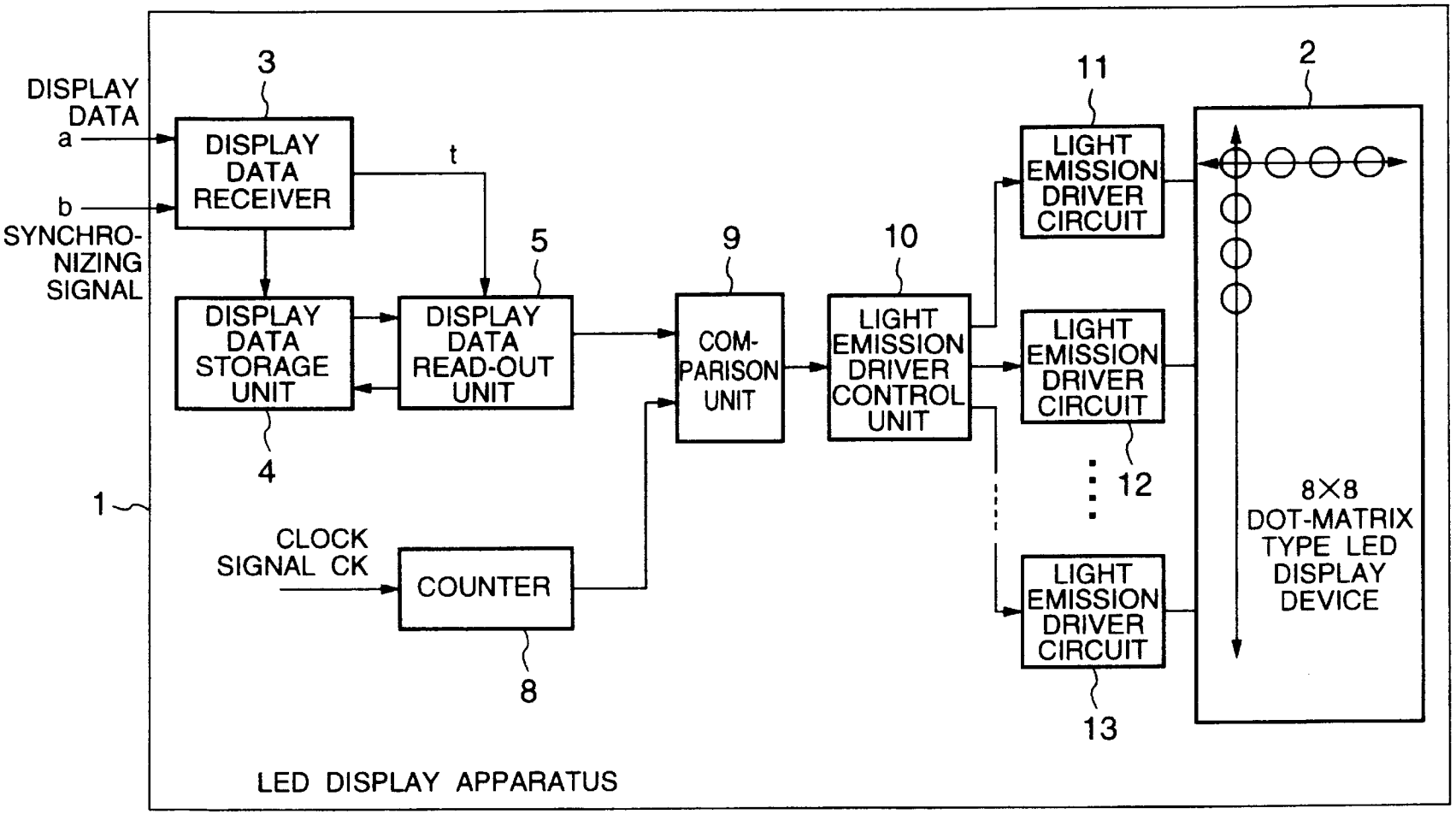
FIG.17 PRIOR ART
FIG. 17 is a block diagram showing a conventional LED display apparatus known heretofore.
Figure 18A:
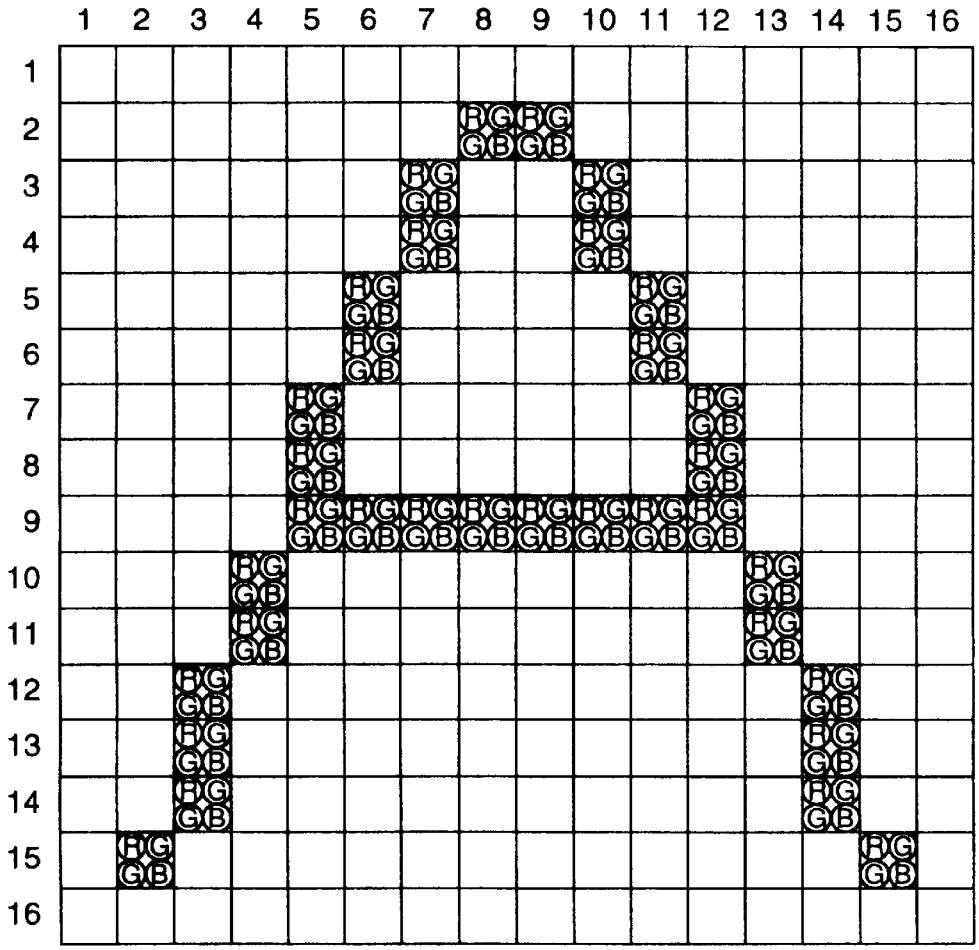
FIG.18A PRIOR ART
FIG. 18A is a view showing a method of displaying data with a conventional LED display apparatus known heretofore.
Figure 18B:
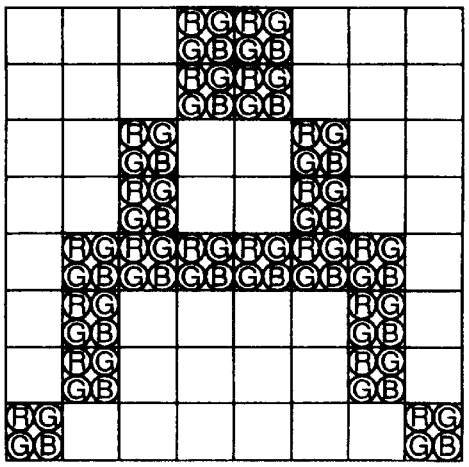
FIG.18B PRIOR ART
FIG. 18B is a view showing a method of displaying data with a conventional LED display apparatus.

FIG. 1 is a block diagram showing a configuration of the LED display apparatus 1 according to a first embodiment of the present invention. In the figure, a dot-matrix type LED display device 2, a display data receiver 3, a display data storage unit 4, a display data read-out unit 5, a counter 8, a comparison unit 9, a light emission driver control unit 10 and light emission driver circuits 11, 12 and 13 are essentially same as or equivalent to those described hereinbefore by reference to FIG. 17. Accordingly, repeated description of these components is omitted while designating them by like reference numerals as used in FIG. 17. According to the invention incarnated in the instant embodiment, an address determining unit 6 is provided for determining the address from which the display data read-out unit 5 reads out the display data a stored in the display data storage unit 4. Additionally, a read-out operation counting unit 7 is provided for counting a number of times the display data read-out operation is performed by the display data read-out unit 5 within one and the same frame.

Figure 2A:
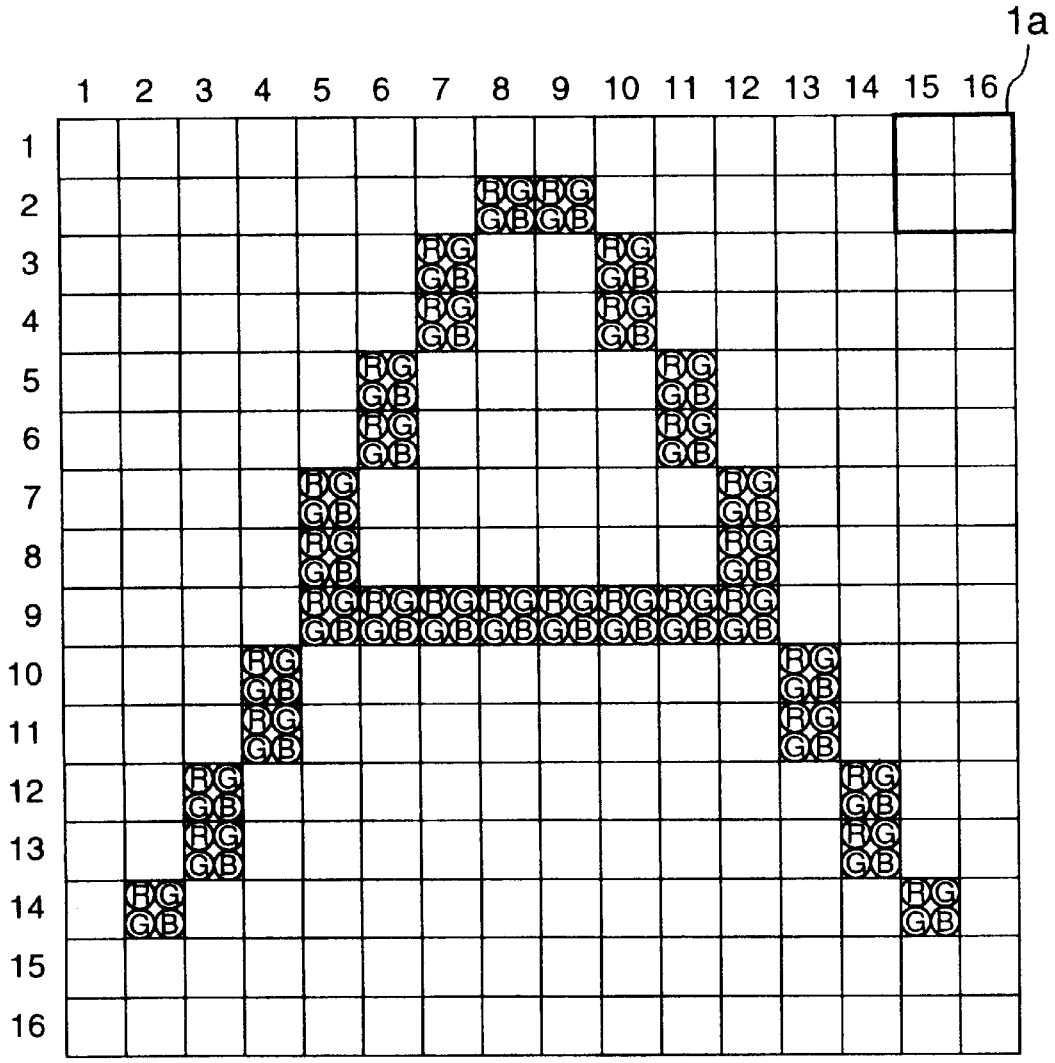
FIG. 2A is a diagram showing display data inputted from a display signal generation source such as a personal computer or the like in a displayed state.
Figure 2B:
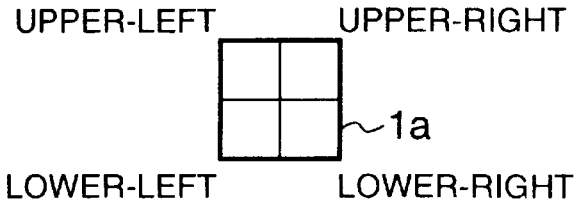
FIG. 2B is a diagram for illustrating that one unit is constituted by 4 (=2×2) dots.
Figure 3A:
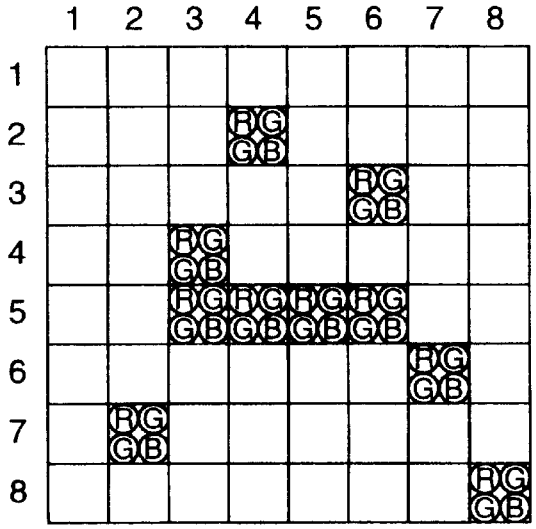
FIG. 3A is an upper-left data diagram showing upper-left data in FIG. 2B.
Figure 3B:
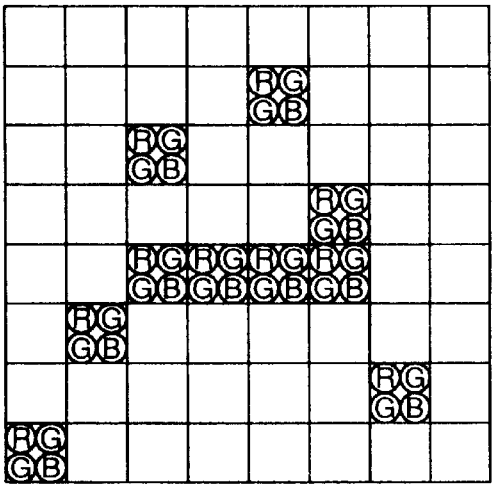
FIG. 3B is an upper-right data diagram showing upper-right data in FIG. 2B.
Figure 3C:
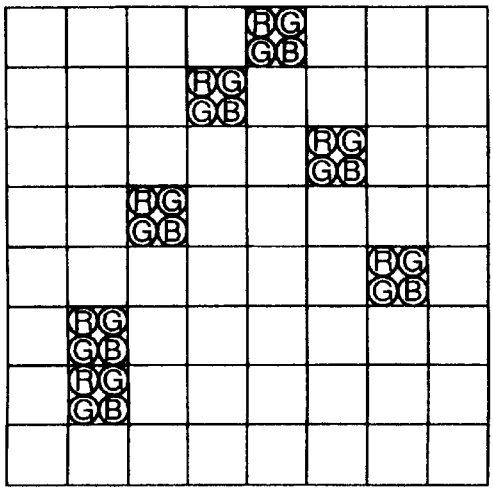
FIG. 3C is a lower-left data diagram showing lower-left data in FIG. 2B.
Figure 3D:
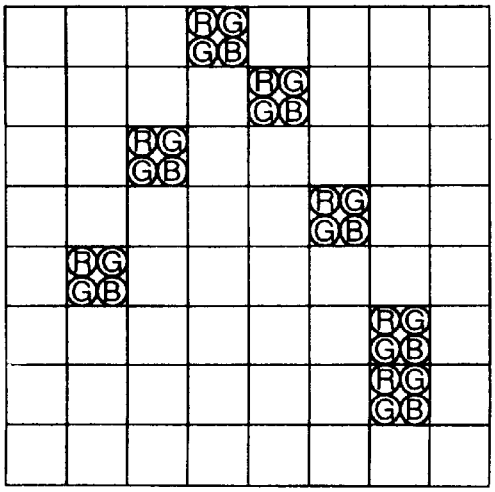
FIG. 3D is a lower-right data diagram showing lower-right data in FIG. 2B.
Figure 4A:
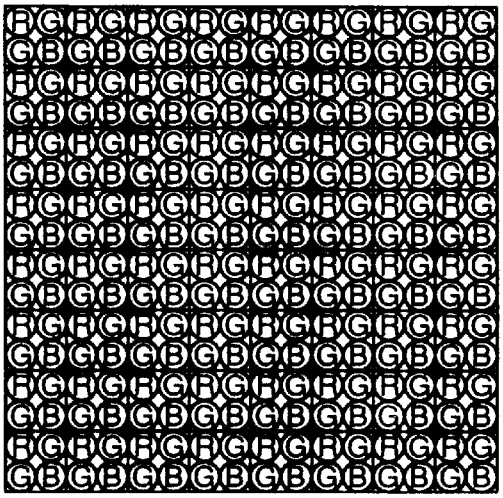
FIG. 4A is an LED driving state diagram illustrating a state in which LEDs are driven in conformance with the upper-left data shown in FIG. 3A.
Figure 4B:
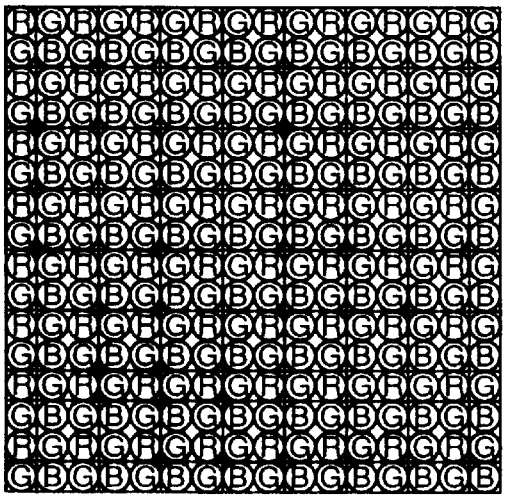
FIG. 4B is an LED driving state diagram illustrating a state in which LEDs are driven in conformance with the upper-right data shown in FIG. 3B.
Figure 4C:
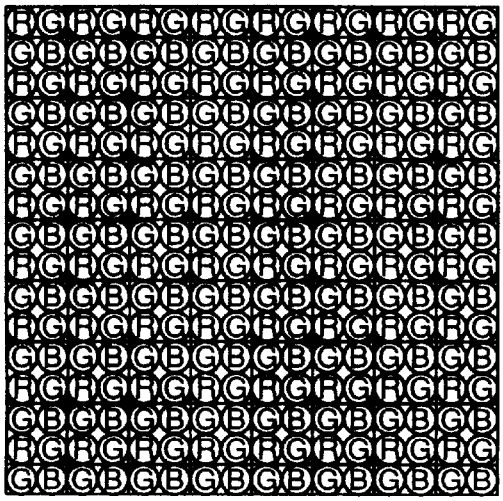
FIG. 4C is an LED driving state diagram illustrating a state in which LEDs are driven in conformance with the lower-left data shown in FIG. 3C.
Figure 4D:
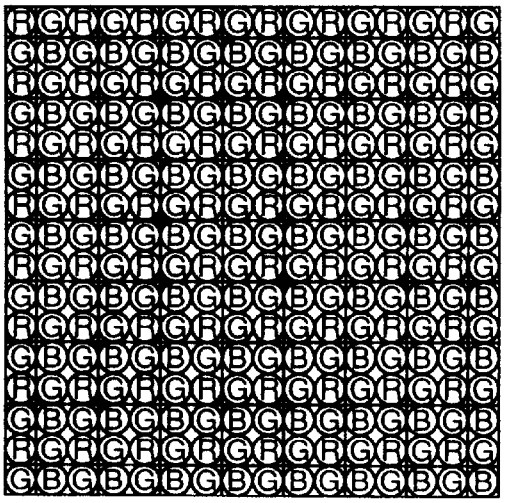
FIG. 4D is an LED driving state diagram illustrating a state in which LEDs are driven in conformance with the lower-right data shown in FIG. 3D.
Figures 5A, 5B:
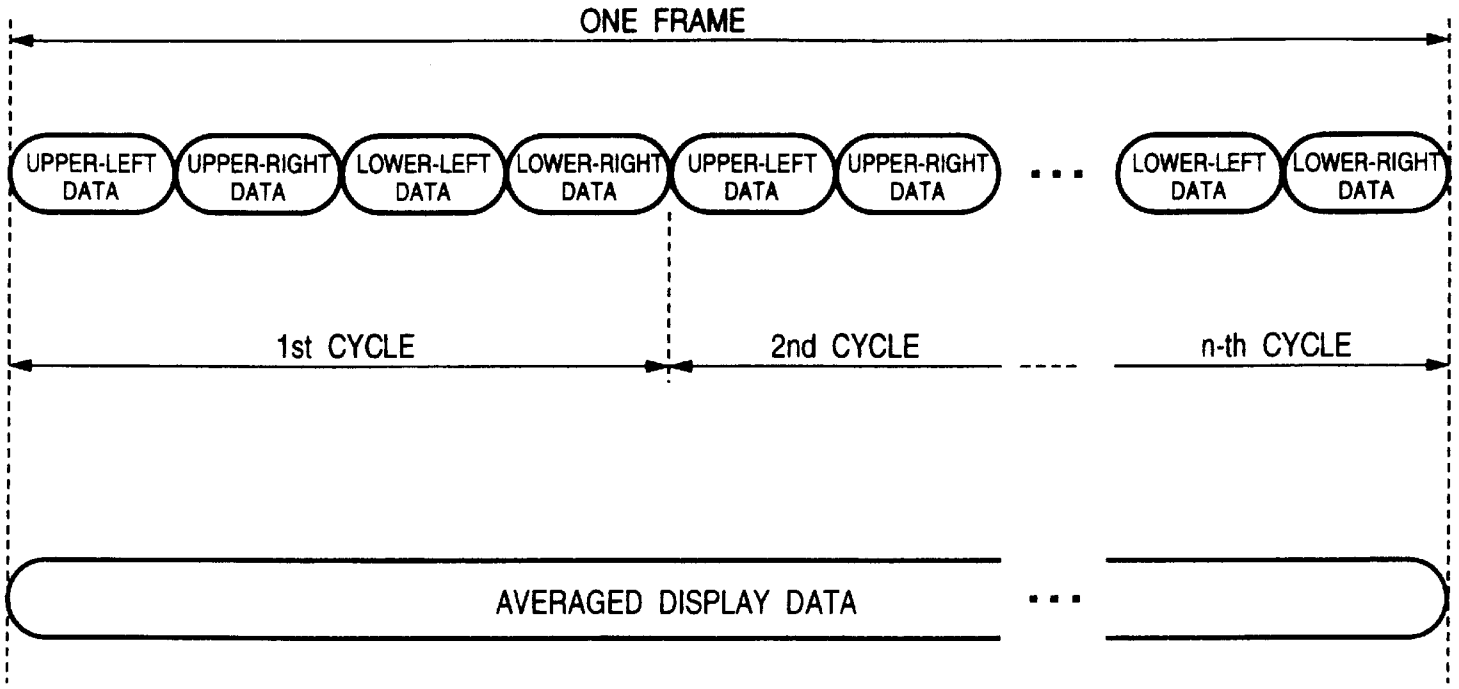
FIG. 5A is a cycle data diagram illustrating output data in each cycle within one frame.
FIG. 5B is an averaged display data output diagram for illustrating a state in which averaged display data are outputted.
Figure 6A:
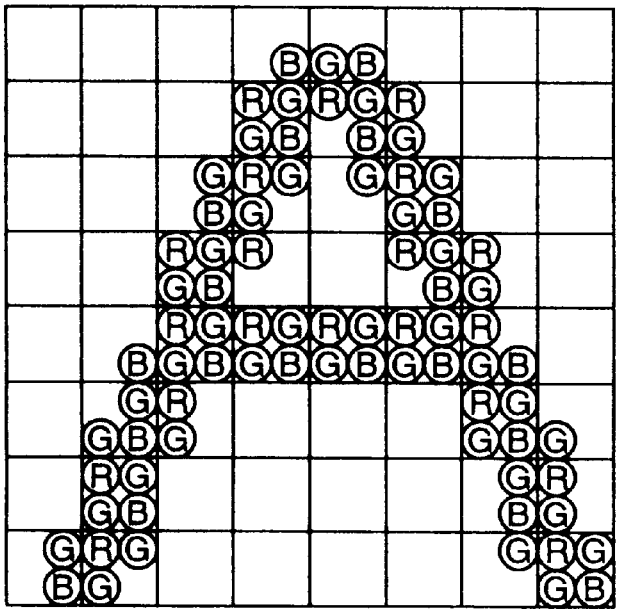
FIG. 6A is a cycle data display diagram showing an image generated on the basis of the cycle data illustrated in FIG. 5A.
Figure 6B:
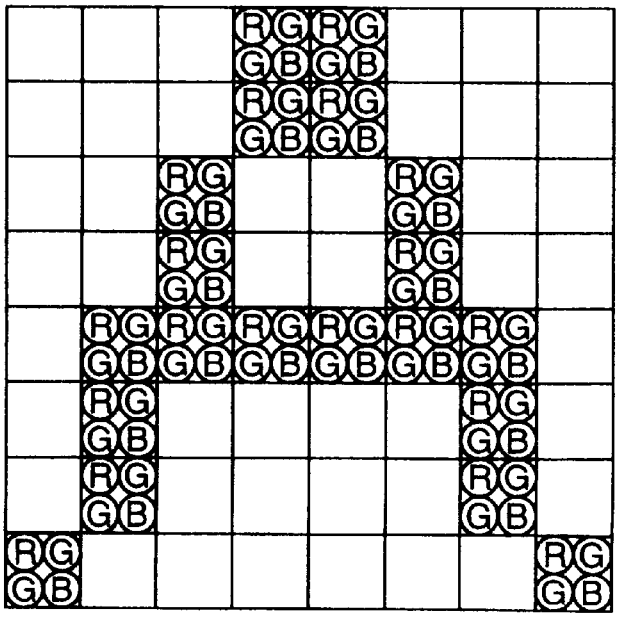
FIG. 6B is an averaged data display diagram showing an image generated on the basis of the averaged display data shown in FIG. 5B.

FIG. 2A is a diagram showing display data (i.e., data to be displayed) a inputted from the display signal generation source such as a personal computer or the like in a displayed state, FIG. 2B is a diagram for illustrating that one unit la is constituted by 4 (=2×2) dots, FIG. 3A is an upper-left data diagram showing upper-left data in FIG. 2B, FIG. 3B is an upper-right data diagram showing upper-right data in FIG. 2B, FIG. 3C is a lower-left data diagram showing lower-left data in FIG. 2B, and FIG. 3D is a lower-right data diagram showing lower-right data in FIG. 2B. FIG. 4A is an LED driving state diagram illustrating a state in which LEDs are driven in conformance with the upper-left data shown in FIG. 3A, FIG. 4B is an LED driving state diagram illustrating a state in which LEDs are driven in conformance with the upper-right data shown in FIG. 3B, FIG. 4C is an LED driving state diagram illustrating a state in which LEDs are driven in conformance with the lower-left data shown in FIG. 3C, and FIG. 4D is an LED driving state diagram illustrating a state in which LEDs are driven in conformance with the lower-right data shown in FIG. 3D. FIG. 5A is a cycle data diagram illustrating output data in each cycle within one frame, and FIG. 5B is an averaged display data output diagram for illustrating a state in which averaged display data are outputted. FIG. 6A is a cycle data display diagram showing an image generated on the basis of the cycle data illustrated in FIG. 5A, and FIG. 6B is an averaged data display diagram showing an image generated on the basis of the averaged display data shown in FIG. 5B.

In the LED display apparatus according to the instant embodiment of the invention, the display data a inputted from the display signal generation source such as the personal computer is composed of 16×16 dots on a frame-by-frame basis (on a character-by-character basis), as illustrated in FIG. 2A, wherein each dot is represented by one red LED (R) (red light emission diode), one blue LED (B)(blue light emission diode) and two green LEDs (G) (green light emission diode), as illustrated in FIGS. 4A–4D. By contrast, the dot-matrix type LED display device 2 is implemented in an 8×8 dot matrix array with each dot being implemented in the same structure as mentioned above. Consequently, when one-to-one correspondence is to be established between the dots of the display data a and those of the dot-matrix type LED display device 2, respectively, it becomes impossible to display on the LED display apparatus 1 more than a quarter of the display data a inputted from the display signal generation source.

FIG. 2A illustrates, only by way of example, an image of an upper case alphabetic character "A" generated on the dot-matrix type LED display device 2 including a dot matrix array of 16×16 dots. The dots designated by R, G and B each in a circle indicate those which are lit while the dots not labeled with R, G and B are in the state not lit.

Next, referring to FIGS. 1 to 6, description will be made concerning the operations of the LED display apparatus 1 implemented in the structure described above.

First referring to FIG. 1, the display data receiver 3 receives the display data (i.e., data to be displayed) a from the display signal generation source such as a personal computer or the like under the timing given by the synchronizing signal b (in a display data receiving step). The display data a received by the display data receiver 3 are stored in the display data storage unit 4 (in a display data storing step). On the other hand, when the display data a stored in the display data storage unit 4 are to be displayed on the dot-matrix type LED display device 2, those of the display data a stored in the display data storage unit 4 which are located at the addresses determined by the address determining unit 6 are read out by the display data read-out unit 5 at a timing determined by a timing signal t which is derived from the synchronizing signal b (in a display data read-out step), whereon the data read out by the display data read-out unit 5 are set at the comparison unit 9.

In that case, the display data a of 16×16 dots each corresponding to a combination of the red, blue and green LEDs as mentioned above and shown in FIGS. 2A and 2B are processed such that the data are divided groupwise into 64 (=8×8) units 1*a* each of which is constituted by 2×2 dots (by a predetermined number of dots, to say in more general terms) for each color (i.e., on a color-by-color basis).

More specifically, only the upper-left data in one unit shown in FIG. 2B is first extracted from all the units and arrayed in the matrix of 8×8 dots as shown in FIG. 3A. Subsequently, the upper-right data, lower-left data and the lower-right data are successively extracted in a similar manner and arrayed such as illustrated in FIGS. 3B, 3C and 3D, respectively. Parenthetically, the display data located at a given position, as mentioned above, will be referred to as the position-related display data. At this juncture, it can readily be seen from FIG. 3A that the display data obtained through the processing mentioned above has a same number of dots (8×8=64) as the dot-matrix type LED display device 2 for each of the colors.

The data group read out is set at the comparison unit 9, and the counter 8 starts to count the clock signal CK. The count value of the clock signal CK is compared with the position-related display data a set at the comparison unit 9.

In this conjunction, assume, only by way of example, that the number of the position-related display data set at the comparison unit 9 is "128". In that case, so long as the count value is smaller than "128" inclusive, the comparison unit 9 outputs a light emission enable signal (e.g. H-level signal) for enabling light emission of the LED. On the contrary, when the count value exceeds "128", the comparison unit 9 outputs a light emission inhibit signal (e.g. L-level signal) for disabling or inhibiting the light emission of the LED.

In response to the output signal from the comparison unit 9, the light emission driver control unit 10 outputs a light emission driver control signal for controlling the light emission driver circuits 11, 12 and 13 for those LEDs of the 8×8-dot-matrix type LED display device 2 shown in FIG. 4A which correspond to the position-related display data (a group of the upper-left data in this case in the 8×8 data matrix) shown in FIG. 3A (light emission driver control step). In response to the light emission driver control signal, the light emission driver circuits 11, 12 and 13 drive or electrically energize the group of the corresponding LEDs.

Upon completion of the processing for the upper-left data illustrated in FIG. 3A, then the upper-right data is processed in a similar manner. More specifically, the signal indicating the number of the read-out operations as performed is inputted to the read-out operation counting unit 7 shown in FIG. 1 from the display data read-out unit 5. In succession to the read-out of the upper-left data illustrated in FIG. 3A, the read-out operation counting unit 7 is incremented (read-out operation number counting step). On the other hand, the address determining unit 6 determines the address corresponding to the updated content of the read-out operation counting unit 7 (address determining step), whereon the newly determined updated address is outputted to the display data read-out unit 5 which responds thereto by reading out the display data stored at the updated address. The display data read out by the display data read-out unit 5 is set at the comparison unit 9.

In that case, the display data read out is a group of the display data (upper-right data) located at the upper-right position in each of the units which result from division of the display data a of 16×16 dots for each color of red, blue and green shown in FIG. 2A into 64 (=8×8) units 1*a* each constituted by 2×2 dots on a color-by-color basis. FIG. 3B shows an array of the upper-right data extracted through the processing mentioned above. Parenthetically, the display data obtained through the processing mentioned above has the same number of dots (8×8=64) as the dot-matrix type LED display device 2 for each color.

The data group as read out is placed at the comparison unit 9, and the counter 8 starts to count the clock signal CK. The count value indicated by the clock signal CK is compared with the position-related display data placed at the comparison unit 9. Assuming that the number of the position-related display data placed at the comparison unit 9 is "128", the comparison unit 9 then outputs the light emission enable signal for enabling light emission of the LED so long as the count value is smaller than "128" inclusive. On the contrary, when the count value exceeds "128", the comparison unit 9 outputs the light emission inhibit signal for inhibiting the light emission of the LED. In response to the output signal from the comparison unit 9, the light emission driver control unit 10 outputs the light emission driver control signal for controlling the light emission driver circuits 11, 12 and 13 for those LEDs of the 8×8-dot-matrix type LED display device 2 which correspond to the position-related display data (a group of the upper-right data in this case) in the 8×8 data matrix shown in FIG. 3B and which are arrayed as shown in FIG. 4B. In response to the light emission driver control signal, the light emission driver circuits 11, 12 and 13 drive or electrically energize the corresponding group of the LEDs of the dot-matrix type LED display device 2. In this case, the array of red, blue and green constituting one dot differs from the array illustrated in FIG. 4A. However, because the color component ratio remains the same, the color balance is never disturbed.

Subsequently, the content of the read-out operation counting unit 7 is incremented while the address determining unit 6 determines the address corresponding to the updated content of the read-out operation counting unit 7, whereon the newly determined updated address is outputted to the display data read-out unit 5 which responds thereto by reading out the display data stored at the updated address. In this way, it is possible to control the light emission driver circuits 11, 12 and 13 so that the LEDs of the dot-matrix type LED display device 2 are driven in a dot pattern shown in FIG. 4C which corresponds to a group of the lower-left data illustrated in FIG. 3C and then in a dot pattern shown in FIG. 4D which corresponds to a group of the lower-right data illustrated in FIG. 3D, respectively.

In succession to the data extraction for the groups of the upper-left data, the upper-right data, the lower-left data and the lower-right data, respectively, through the processing procedure described above, then the upper-left data group, the upper-right data group, the lower-left data group and the lower-right data group are sequentially displayed in this order on a time-division basis. The display in this case is so performed as to deviate the data of each group by one LED (i.e., by a half dot).

More specifically, when the LED constituting the dot for which the data exists is lit for a predetermined time period for displaying the upper-left data shown in FIG. 3A, then the red LED (R) corresponding to the upper-left position of the dot located at the first row and first column in the upper-left data shown in FIG. 3B is lit for a predetermined time period in superposition to the green LED (G) corresponding to the upper-right position of the dot located at the first row and first column in the data shown in FIG. 3A.

Similarly, when the lower-left data shown in FIG. 3C is displayed, the red LED (R) corresponding to the upper-left portion of the dot located at the first row and first column in the data shown in FIG. 3C is lit for a predetermined time period in superposition to the green LED (G) corresponding to the lower-left portion of the dot located at the first row and first column in the data shown in FIG. 3A. When the lower-right data shown in FIG. 3D is displayed, the red LED (R) corresponding to the upper-left portion of the dot positioned at the first row and first column in the data shown in FIG. 3D is displayed for a predetermine time period in superposition to the blue LED (B) corresponding to the lower-right portion of the dot located at the first row and first column in the data shown in FIG. 3A.

In this manner, the four groups of data are displayed for all the dots successively on a time-division basis with deviation of a half dot to one another, wherein a series of operations required for the display mentioned above is defined as one cycle, as is illustrated in FIG. 5A. By repeating such cycle a number of times within one and the same frame for the purpose of suppressing the so-called flicker phenomenon, there can be displayed an image improved in respect to the contour, as illustrated in FIG. 6A.

Although it has been mentioned that the successive displays are performed with the deviation of a half dot relative to one another, it should be noted that such relative deviation is experimentally determined. It goes without saying that the magnitude of the deviation may appropriately be selected in dependence on the number of dots belonging to the one unit or the number of dots to be realized after the transformation or conversion.

For illustrating the advantageous effects achieved with the invention, FIG. 5B shows averaged display data derived by averaging four data which constitute one unit of 2×2 dots from the display data of 16×16 dots inputted to the display data receiver 3, and FIG. 6B shows an image displayed by driving the LEDs of the 8×8-dot-matrix type LED display device 2 in conformance with the averaged display data. As can be seen from comparison of FIG. 6A and FIG. 6B, the image displayed on the basis of the averaged display data is degraded in respect to the resolution and hence in the picture quality.

In the LED display apparatus according to the instant embodiment of the invention, a plurality of planes are synthesized with positional deviation within a same frame for the display by the dot-matrix type LED display device 2. There will exist such a dot which undergoes duplicate light emission, involving different distribution of luminance, although not shown in the figure. The same holds true in the following description directed to other embodiments of the invention.

As is apparent from the foregoing description, with the LED display apparatus according to the first embodiment of the invention, it is possible to generate a color display of high quality even with the dot-matrix type LED display unit or device having a small number of dots and low resolution by virtue of such arrangement that the four (=2×2) dots of the input display data within a same frame are handled as one unit and the LED groups incorporated in the dot-matrix type LED display device 2 of 8×8 dot matrix are driven for light emission while changing the light emission drive array for the four data of each unit.

Embodiment 2

The second embodiment of the present invention is directed to an LED display apparatus for displaying the data of 16×16 dot matrix on the 8×8-dot-matrix type LED display device 2, which apparatus is capable of displaying exchangeably image data in reduction as described in conjunction with the first embodiment and a portion of the data with equi-magnification.

Figure 7:
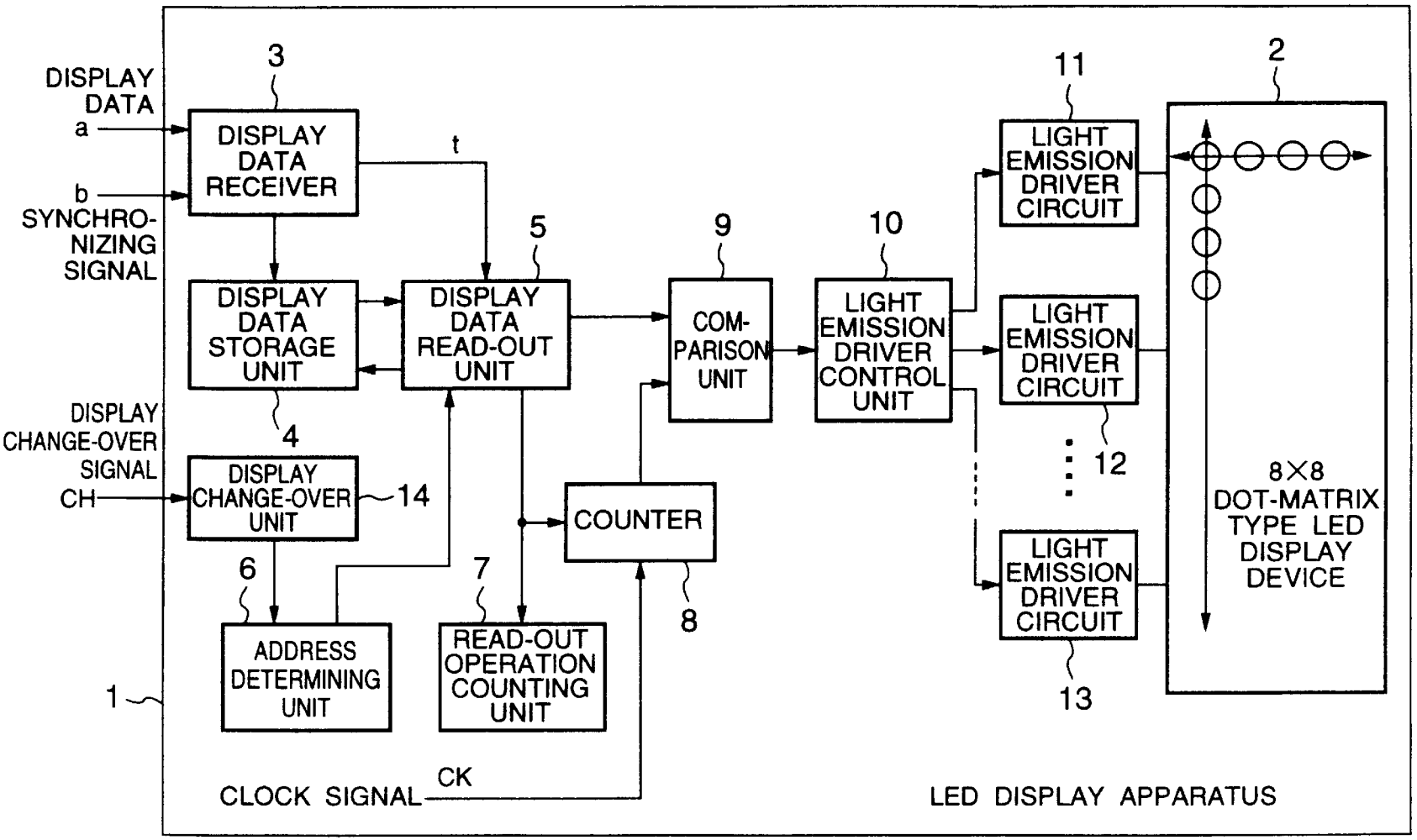
FIG. 7 is a block diagram showing a configuration of an LED display apparatus to which second to fourth embodiments of the present invention is applied.

FIG. 7 is a block diagram showing a configuration of an LED display apparatus to which second to fourth embodiments of the present invention are applied. In the figure, a dot-matrix type LED display device 2, a display data receiver 3, a display data storage unit 4, a display data read-out unit 5, an address determining unit 6, a read-out operation counting unit 7, a counter 8, a comparison unit 9, a light emission driver control unit 10 and light emission driver circuits 11, 12 and 13 are essentially same as or equivalent to those described hereinbefore by reference to FIG. 1. Accordingly, repeated description of these components is omitted while designating them by like reference characters as used in FIG. 1. A display change-over unit 14 serves for changing over display modes of the dot-matrix type LED display device 2 in response to a display change-over signal CH. In this conjunction, the display modes of the LED display apparatus according to the instant embodiment includes a contraction or reduction mode and an equi-magnification mode.

Figure 8A:
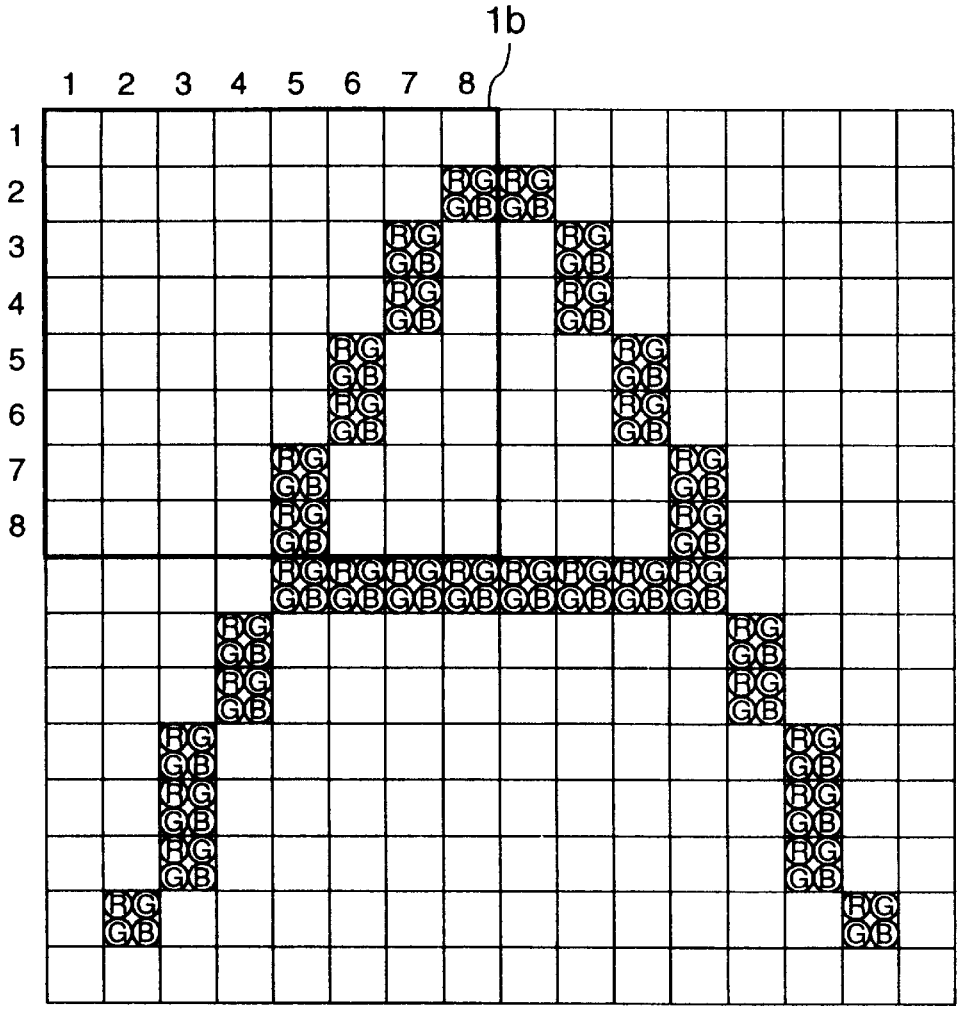
FIG. 8A is a diagram showing display data inputted to a display data receiver.
Figure 8B:
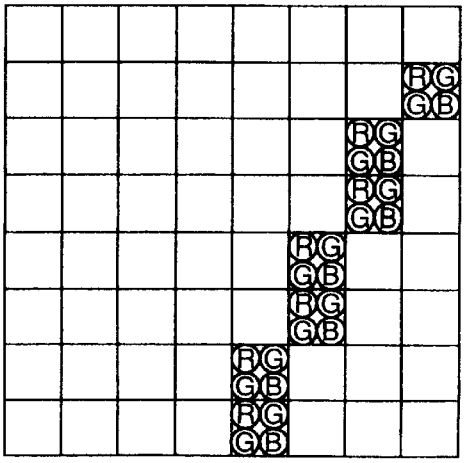
FIG. 8B is a diagram for illustrating an equi-magnification display mode.

Next, by reference to FIGS. 8A and 8B, description will be directed to the operations of the LED display apparatus implemented in the structure described above. FIG. 8A is a diagram for illustrating display data a inputted to the display data receiver 3 and FIG. 8B is a diagram showing an equi-magnification display mode. Parenthetically, the input display data a processed by the LED display apparatus according to the instant embodiment of the invention is the same as that described hereinbefore in conjunction with the first embodiment. Further, since the operation of the LED display apparatus in the reduction or contraction mode is essentially the same as that of the apparatus according to the first embodiment of the invention, repeated description is omitted. Accordingly, the following description will be directed to the operation of the LED display apparatus in the equi-magnification mode.

The display data a supplied from the display signal generation source is received by the display data receiver 3 under the timing given by the synchronizing signal b. The display data a received by the display data receiver 3 are stored temporarily in the display data storage unit 4. On the other hand, when the display data a stored in the display data storage unit 4 are to be displayed on the dot-matrix type LED display device 2, those of the display data a stored in the display data storage unit 4 which are located at the addresses determined by the address determining unit 6 are read out by the display data read-out unit 5 at a timing determined by a timing signal t which is derived from the synchronizing signal b, whereon the data read out by the display data read-out unit 5 are placed at the comparison unit 9. In this conjunction, it is to be noted that because the LED display apparatus is set in the equi-magnification mode by the display change-over unit 14, the display data (i.e., data to be displayed) are 8×8-dot data indicated as enclosed by a thick solid line block 1*b* in FIG. 8A. In this case, the number of data for each of the colors is same as the number of dots in the dot-matrix type LED display device 2.

The data group as read out is placed at the comparison unit 9, and the counter 8 starts to count the clock signal CK. The count value indicated by the clock signal CK is compared with the position-related display data placed at the comparison unit 9. Assuming that the number of the display data placed at the comparison unit 9 is "128", the comparison unit 9 then outputs the light emission enable signal for enabling light emission of the LED so far as the count value is smaller than "128" inclusive. On the contrary, when the count value exceeds "128", the comparison unit 9 outputs the light emission inhibit signal for inhibiting the light emission of the LED. In response to the output signal from the comparison unit 9, the light emission driver control unit 10 outputs the light emission driver control signal for controlling the light emission driver circuits 11, 12 and 13 for those LEDs of the 8×8-dot-matrix type LED display device 2 which correspond to the 8×8 data indicated as enclosed by a thick solid line block 1*b* in FIG. 8A and which are arrayed in such dot pattern as shown in FIG. 4A. In response to the light emission driver control signal, the light emission driver circuits 11, 12 and 13 drive the corresponding LEDs of the dot-matrix type LED display device 2. In this case, such an image as illustrated in FIG. 8B is displayed on the dot-matrix type LED display device 2. In other words, because of the equi-magnification mode, a quarter of the display data shown in FIG. 8A is displayed.

As is apparent from the above description, the display mode can be changed over between the reduction mode and the equi-magnification mode in response to the display change-over signal CH, whereby displays on the dot-matrix type LED display device 2 can be changed over correspondingly.

Embodiment 3

The third embodiment of the present invention is directed to an LED display apparatus having an ordinary mode for displaying simultaneously a plurality of images in different regions, respectively, on a same screen and a synthesizing mode for displaying a plurality of images alternately and successively in a same region of a same screen on a time-division basis so that the plurality of images create an appearance as if they were synthesized.

The LED display apparatus according to the instant embodiment of the invention can be implemented in essentially the same configuration as in the case of the second embodiment described previously. The third embodiment of the invention differs from the second embodiment only in respect to the function of the display change-over unit 14.

Figure 9:
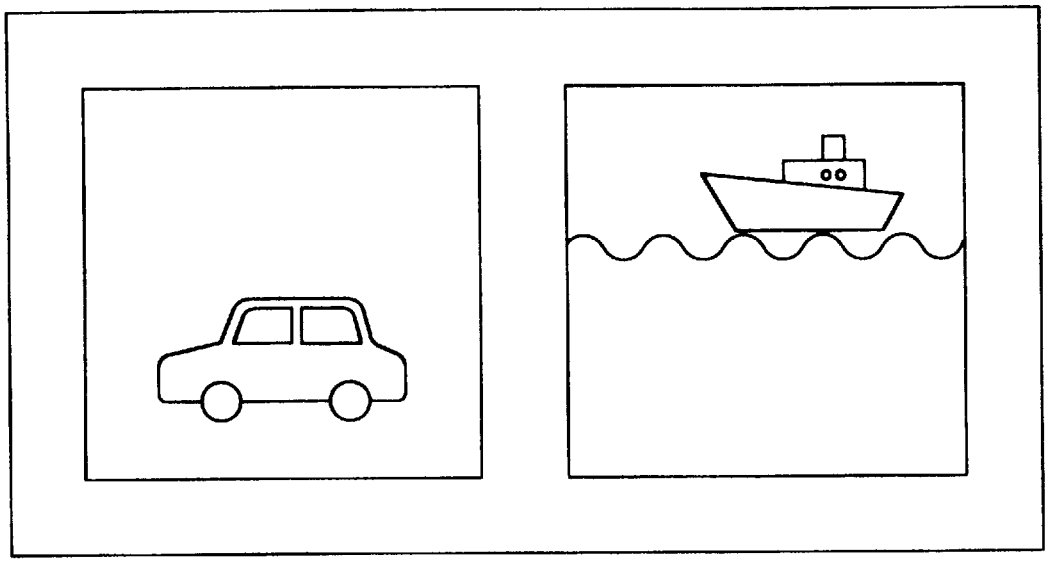
FIG. 9 is a schematic diagram for illustrating display data inputted to a display data receiver.
Figure 11:
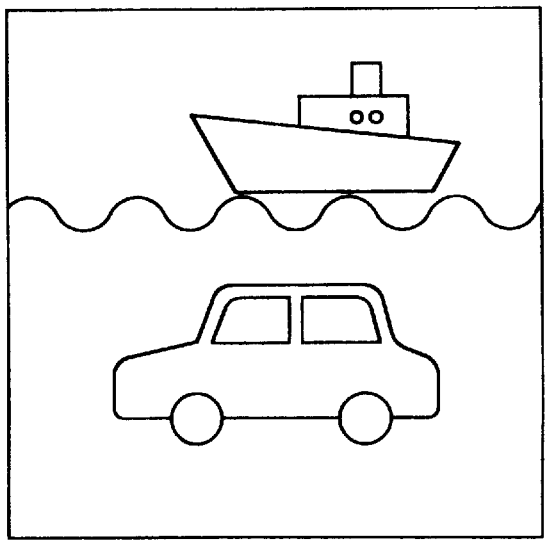
FIG. 11 is a view for illustrating a result of synthesization or combination of images effectuated in a synthesizing mode.
Figure 10:
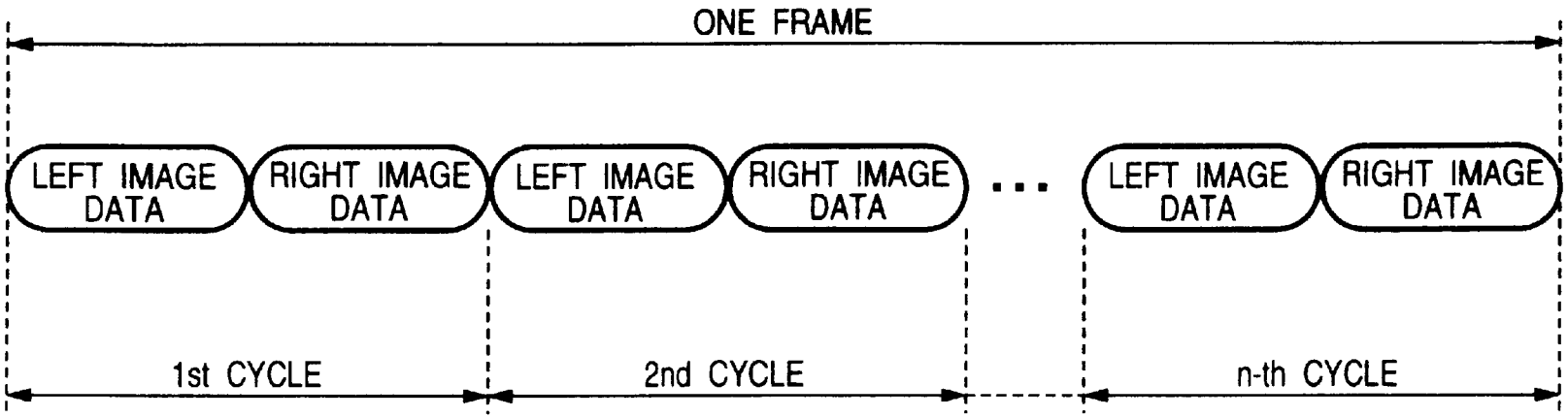
FIG. 10 is a diagram for illustrating data outputted during individual cycles within one frame.

In the LED display apparatus according to the instant embodiment of the invention, the display change-over unit 14 is so designed as to be able to set interchangeably two display modes, i.e., the ordinary mode and the synthesizing mode, as mentioned above. Since the ordinary mode is essentially similar to the equi-magnification mode described hereinbefore in conjunction with the second embodiment, description of the ordinary mode is omitted. The following description is directed to the operation in the synthesizing mode by reference to FIGS. 9 to 11, in which FIG. 9 is a schematic diagram for illustrating the display data a received by the display data receiver 3 from the display signal generation source, FIG. 10 is a diagram for illustrating cycle data outputted during individual cycles within one frame, and FIG. 11 is a view for illustrating a result of synthesization effectuated in the synthesizing mode. More specifically, there are generated on the dot-matrix type LED display device 2 a first window in which a car is displayed and a second window in which a ship on the sea is displayed, wherein the first and second windows are generated at different locations on the dot-matrix type LED display device 2, as can be seen from FIG. 9. In the ordinary mode, the display data is shown in a portion of the window displaying the car or the ship on the sea in dependence on the number of LEDs of the 8×8-dot-matrix type LED display device 2.

Now, description will turn to the operations of the LED display apparatus in the synthesizing mode. At first, the display data a supplied from the display signal generation source is received by the display data receiver 3 at a timing given by the synchronizing signal b. The display data a received by the display data receiver 3 are stored temporarily in the display data storage unit 4. On the other hand, when the display data a stored in the display data storage unit 4 are to be displayed on the dot-matrix type LED display device 2, those of the display data a stored in the display data storage unit 4 which are located at the addresses determined by the address determining unit 6 are read out by the display data read-out unit 5 to be set at the comparison unit 9. In that case, because the display change-over unit 14 is set to the synthesizing mode by the display change-over unit 14, the display data as read out are for the window in which the car is to be displayed. See FIG. 9.

The signal indicating the number of the read-out operations as performed is inputted to the read-out operation counting unit 7 from the display data read-out unit 5. In succession to the read-out of the data for the window for displaying the car, the read-out operation counting unit 7 is counted up or incremented. On the other hand, the address determining unit 6 determines the address corresponding to the updated content of the read-out operation counting unit 7, whereon the newly determined updated address is outputted to the display data read-out unit 5 which responds thereto by reading out the display data stored at the updated address. The display data read out by the display data read-out unit 5 is set at the comparison unit 9. The display data read out at this time point are for the window displaying the ship on the sea shown in FIG. 9, because the display change-over unit 14 is set in the synthesizing mode.

A series of the operations mentioned above is defined as one cycle of operations. Such cycle is repeated a number of times within one and the same frame, as illustrated in FIG. 10. By repeating a number of times the cycles for driving the LEDs corresponding to the groups of dots for the left-hand image data (data for the window displaying the car) and the right-hand image data (data for the window displaying the ship on the sea), respectively, there can be generated a synthesized image display for the left-hand and right-hand images in which the car is observed as if it were moving under the sea surface.

As is apparent from the above, the display mode of the LED display apparatus can be changed over between the ordinary mode and the synthesizing mode in response to the display change-over signal CH in the LED display apparatus according to the invention incarnated in the third embodiment, whereby displays on the dot-matrix type LED display device 2 can be changed over correspondingly.

Embodiment 4

A fourth embodiment of the present invention is directed to an LED display apparatus having a reduction mode, an equi-magnification mode, an ordinary mode and a synthesizing mode for displaying an image or images exchangeably on a frame-by-frame basis.

The LED display apparatus according to the instant embodiment can be implemented in essentially the same configuration as that the second embodiment described previously. The fourth embodiment of the invention differs from the second embodiment only in respect to the function of the display change-over unit 14.

In the LED display apparatus according to the instant embodiment of the invention, the display change-over unit 14 is so designed as to be capable of setting the reduction mode, the equi-magnification mode, the ordinary mode and the synthesizing mode. Since these modes have been described hereinbefore, repeated description thereof will be unnecessary.

The following description will be directed to the function and operation of the display change-over unit 14 incorporated in the LED display apparatus according to the instant embodiment of the invention by reference to FIGS. 12A to 12E, in which FIG. 12A is a timing chart for illustrating the synchronizing signal b, FIG. 12B is a timing chart for illustrating the display modes indicated by the display change-over signal CH, FIG. 12C is a timing chart showing sampling time points, FIG. 12D is a timing chart for illustrating display modes set by the display change-over unit 14, and FIG. 12E is a diagram for illustrating contents of displays generated on the dot-matrix type LED display device 2.

As can be seen in FIGS. 12A–12E, the synchronizing signal b indicating the punctuation or delimiter for each of the frames (see FIG. 12A) and the display change-over signal CH (see FIG. 12B) are inputted at the timings as illustrated. In the LED display apparatus according to the instant embodiment of the invention, the address determining unit 6 samples the display mode set at the display change-over unit 14 at the sampling timing illustrated in FIG. 12C before the display data read-out unit 5 reads out the display data (i.e., data to be displayed) from the display data storage unit 4. Consequently, the address determining unit 6 is set to the display mode illustrated in FIG. 12D. The display mode in turn determines the address(es) at which the display data read-out unit 5 reads out the display data from the display data storage unit 4. In this manner, the contents of the display to be generated on the dot-matrix type LED display device 2 can be changed over on a frame-by-frame basis.

By virtue of the arrangement of the LED display apparatus described above, the display modes can be changed over on a frame-by-frame basis by sampling the display change-over signals indicating the different display modes, respectively. Thus, it is possible to change over on a frame-by-frame basis the displays or images generated on the dot-matrix type LED display device 2.

Embodiment 5

The fifth embodiment of the present invention is directed to an LED display apparatus for displaying the data of a 16×16 dot matrix on the 8×8-dot-matrix type LED display device 2, which apparatus is capable of displaying the image data on a further reduced scale in the form of a 4×4 dot matrix by resorting to the same method adopted in the first embodiment of the invention.

Figure 13:
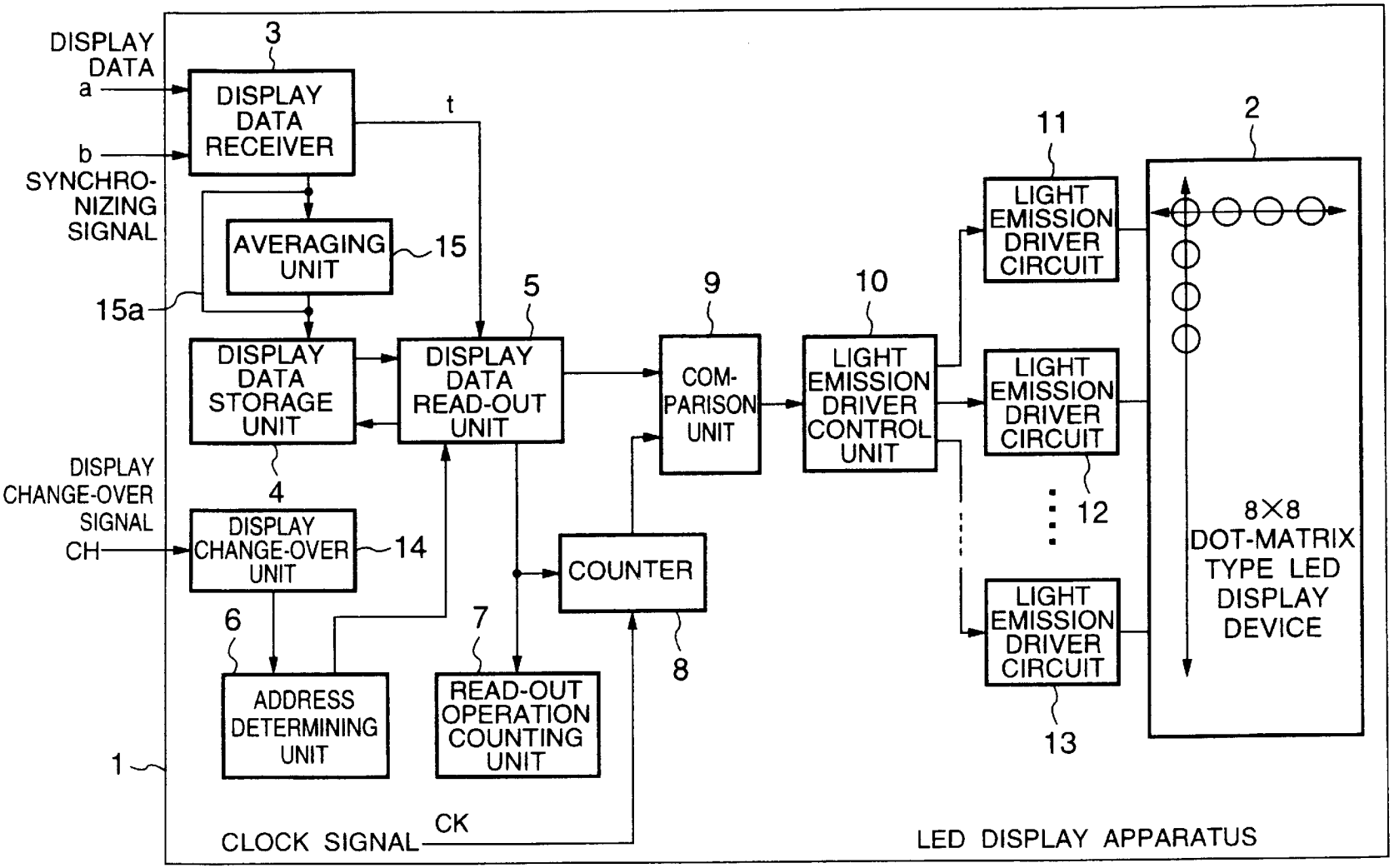
FIG. 13 is a block diagram showing a configuration of an LED display apparatus according to a fifth embodiment of the present invention.

FIG. 13 is a block diagram showing a configuration of an LED display apparatus 1 according to the fifth embodiment of the present invention. In the figure, a dot-matrix type LED display device 2, a display data receiver 3, a display data storage unit 4, a display data read-out unit 5, an address determining unit 6, a read-out operation counting unit 7, a counter 8, a comparison unit 9, a light emission driver control unit 10, light emission driver circuits 11, 12 and 13 and a display change-over unit 14 are essentially same as or equivalent to those described hereinbefore by reference to FIG. 7. Accordingly, these components are designated by like reference characters as used in FIG. 7 and repeated description thereof is omitted. In the LED display apparatus according to the instant embodiment of the invention, an averaging unit 15 is provided for averaging the display data for a predetermined number of dots constituting one unit when the display data a received by the display data receiver 3 are stored in the display data storage unit 4. Further, the averaging unit 15 is provided with a bypass-signal line 15*a* for bypassing the display data a outputted from the display data receiver 3. Parenthetically, it should be mentioned that the display data a supplied to the display data receiver 3 from the display signal generation source is similar to the data handled or processed in the LED display apparatus according to the first embodiment of the invention.

Figure 14A:
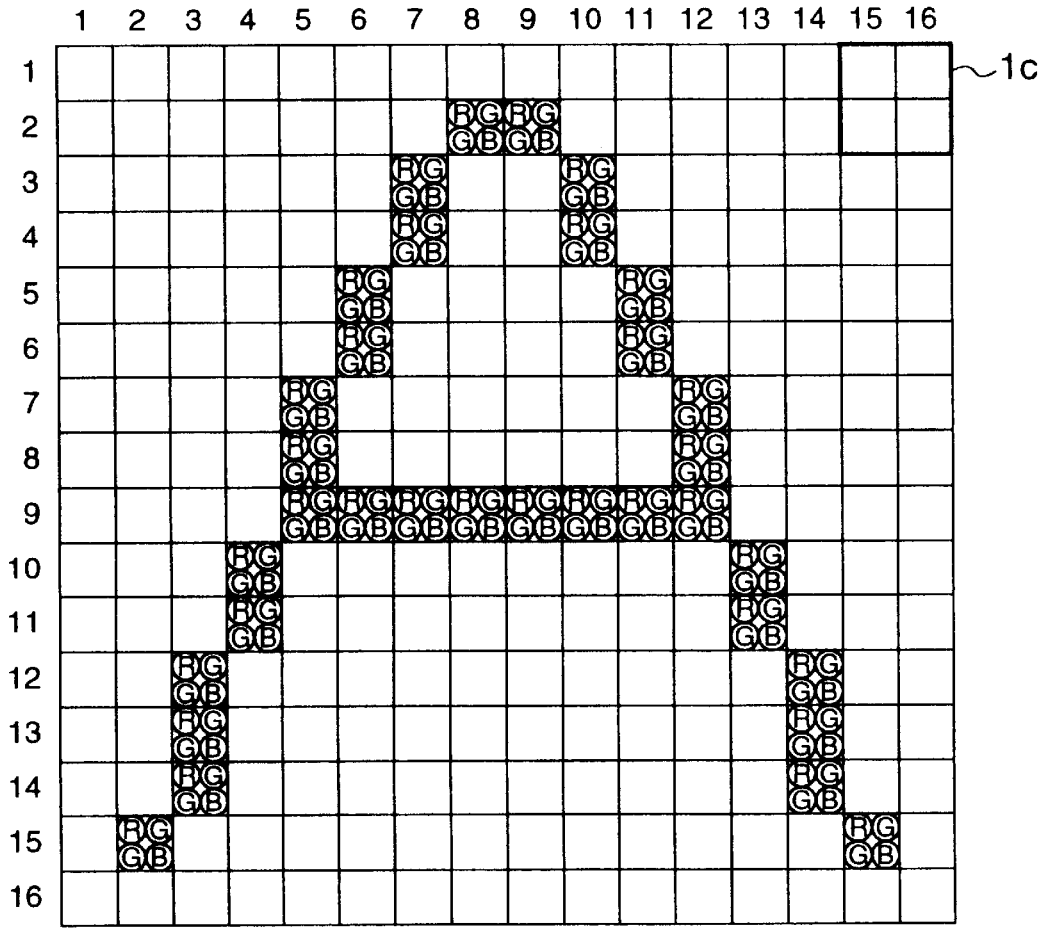
FIG. 14A is a diagram showing display data inputted from a display signal generation source such as a personal computer or the like in a displayed state.
Figure 14B:
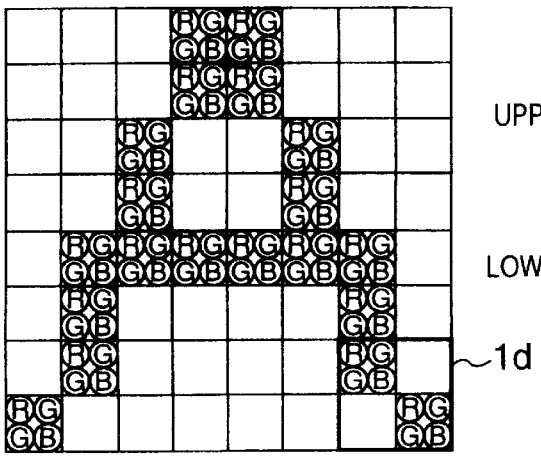
FIG. 14B is a diagram for illustrating an image generated on the basis of data obtained by averaging the display data shown in FIG. 14A with 4 (=2×2) dots.
Figure 14C:
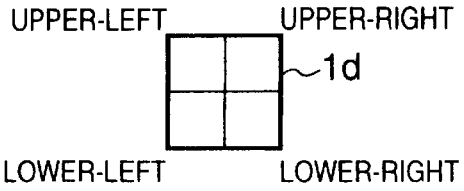
FIG. 14C is a diagram showing one unit resulting from division of the averaged data shown in FIG. 14B into 16 (=4×4) units.
Figure 15A:
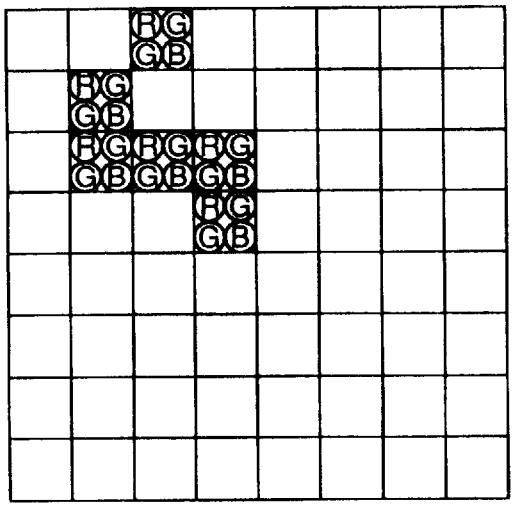
FIG. 15A is a diagram illustrating upper-left data in FIG. 14A.
Figure 15B:
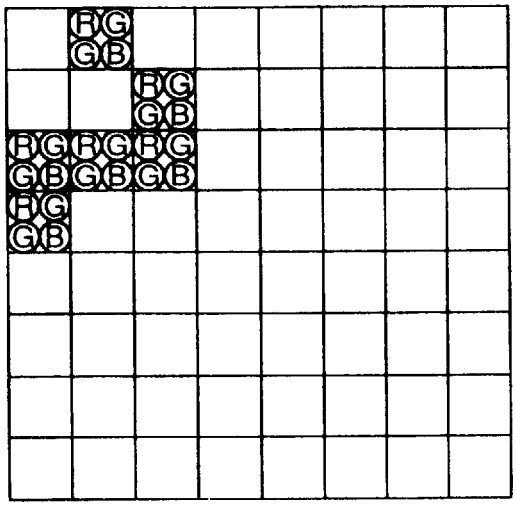
FIG. 15B is a diagram illustrating upper-right data in FIG. 14B.
Figure 15C:
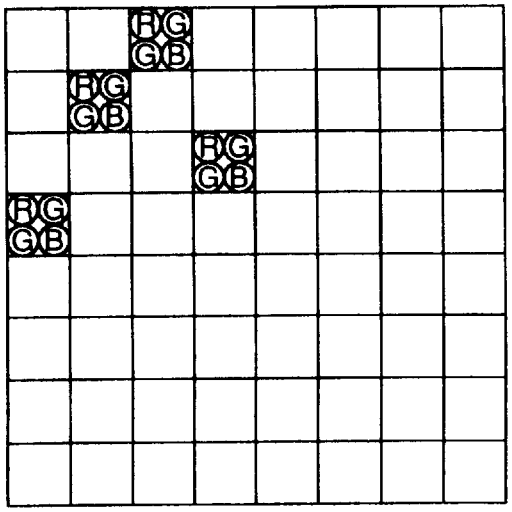
FIG. 15C is a diagram illustrating lower-left data in FIG. 14C.
Figure 15D:
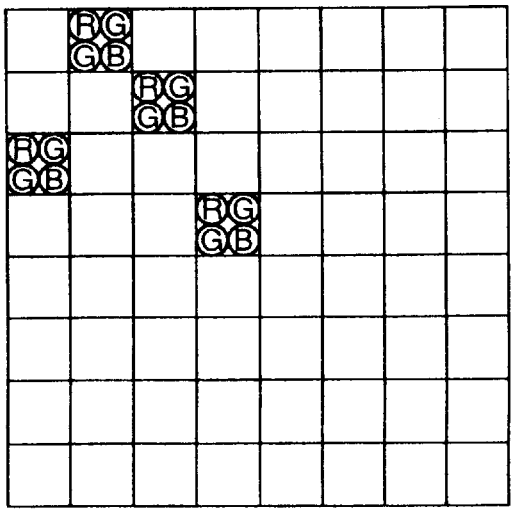
FIG. 15D is a diagram illustrating lower-right data in FIG. 14D.
Figure 16A:
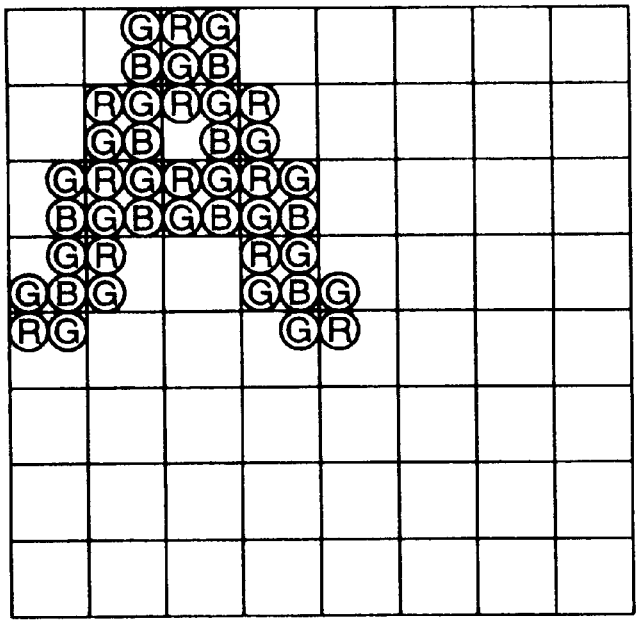
FIG. 16A is a diagram illustrating an image generated on the basis of the data shown in FIGS. 15A to 15D.
Figure 16B:
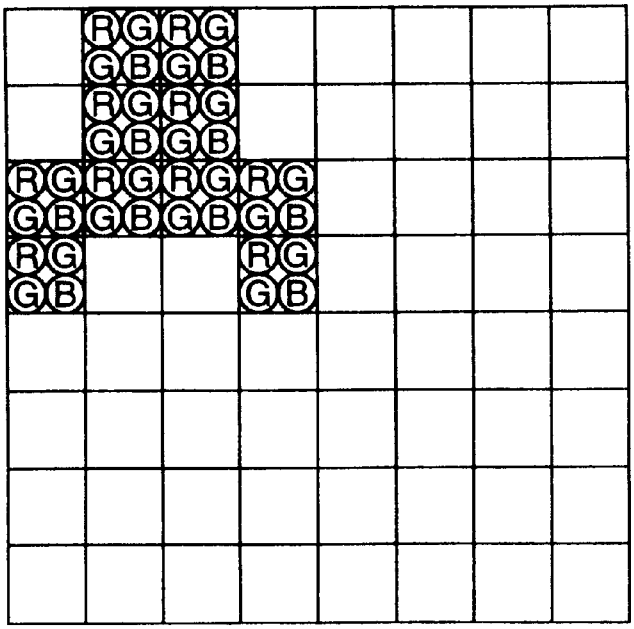
FIG. 16B is a diagram illustrating an image displayed on the basis of averaged display data.

Now, description will be directed to the operations of the LED display apparatus implemented in the aforementioned structure by reference to FIGS. 14 to 16 in which FIG. 14A is a diagram showing display data (i.e., data to be displayed) inputted from the display signal generation source such as a personal computer or the like in a displayed state, FIG. 14B is a diagram for illustrating an image generated on the basis of data obtained by averaging the display data shown in FIG. 14A with 4 (=2×2) dots, FIG. 14C is a diagram showing one unit resulting from the division of the averaged data shown in FIG. 14B into 16 (=4×4) units, FIG. 15A is a diagram illustrating upper-left data in FIG. 14A, FIG. 15B is a diagram illustrating upper-right data in FIG. 14B, FIG. 15C is a diagram illustrating lower-left data in FIG. 14C, FIG. 15D is a diagram illustrating lower-right data in FIG. 14D, FIG. 16A is a diagram illustrating an image generated on the basis of the data shown in FIGS. 15A to 15D, and FIG. 16B is a diagram illustrating an image displayed on the basis of the averaged display data.

Now, operation of the LED display apparatus 1 will be described. The display data receiver 3 receives the display data a from the display signal generation source such as a personal computer or the like at the timing derived from the synchronizing signal b. The averaging unit 15 generates averaged data (see FIG. 14B) obtained from the received display data a by averaging the pixel data of 4 (=2×2) dots (a first predetermined number of dots) indicated as enclosed by a thick solid line block 1*c* (see FIG. 14A), whereon the averaged data is stored in the display data storage unit 4. Parenthetically, it should be mentioned that the bypass-signal line 15*a* is depicted only for indicating that the displays can be changed over on the frame-by-frame basis in response to the change-over of the display modes and plays no role in the LED display apparatus according to the instant embodiment. On the other hand, when the averaged data stored in the display data storage unit 4 are to be displayed on the dot-matrix type LED display device 2, those of the average data stored temporarily in the display data storage unit 4 which are located at the addresses determined by the address determining unit 6 are read out by the display data read-out unit 5, whereon the data read out by the display data read-out unit 5 are set at the comparison unit 9. In that case, the averaged data as read out represents a group of display data (upper-left data) located at an upper-left position in each of 16 (=4×4) units which are obtained by dividing the averaged data of 8×8 dots groupwise into the units 1*d* each of 2×2 dots (a second predetermined number of dots) for each of colors of red, blue and green (i.e., on a color-by-color basis). FIG. 15A illustrates an example of the upper-left data extracted as mentioned above. The group of data shown in FIG. 15A is read out at first. Parenthetically, the averaged data located at a given position will be referred to as the position-related averaged data. At this juncture, it can readily be understood from FIG. 15A that the averaged data obtained through the processing mentioned above has a number of dots equal to a quarter of the dot number of the dot-matrix type LED display device 2 (i.e., 16=64×¼).

The data group read out from the display data storage unit 4 is set at the comparison unit 9, and the counter 8 starts to count the clock signal CK. The count value of the clock signal CK is compared with the position-related averaged data group at the comparison unit 9. In this conjunction, assume, only by way of example, that the number of the position-related averaged data set at the comparison unit 9 is "128". In that case, so long as the count value is smaller than "128" inclusive, the comparison unit 9 outputs a light emission enable signal (e.g. H-level signal) for enabling light emission by the LED. On the contrary, when the count value exceeds "128", the comparison unit 9 outputs a light emission inhibit signal (e.g. L-level signal) for disabling or inhibiting the light emission of the LED. In response to the output signal from the comparison unit 9, the light emission driver control unit 10 outputs a light emission driver control signal for controlling the light emission driver circuits 11, 12 and 13 for the LEDs of the LED display device 2 arrayed in the 8×8 dot matrix as shown in FIG. 4A for the 16 (4×4) position-related averaged data (group of the upper-left data) shown in FIG. 15A (light emission driver control step). In response to the light emission driver control signal, the light emission driver circuits 11, 12 and 13 drive or electrically energize the corresponding LED groups.

Next, the signal indicating the number of the read-out operations as performed is inputted to the read-out operation counting unit 7 from the display data read-out unit 5. In succession to the read-out of the upper-left data illustrated in FIG. 15A, the read-out operation counting unit 7 is incremented. On the other hand, the address determining unit 6 determines the address corresponding to the updated content of the read-out operation counting unit 7, whereon the newly determined updated address is outputted to the display data read-out unit 5 which responds thereto by reading out the averaged data stored at the updated address. The averaged data read out by the display data read-out unit 5 is set at the comparison unit 9. In that case, the averaged data read out is a group of the display data (upper-right data) located at the upper-right position in each of the units which result from division of the averaged data of 8×8 dots for each color of red, blue and green shown in FIG. 14B into 16 (=4×4) units 1*d* each constituted by 2×2 dots on a color-by-color basis. FIG. 15B shows an array of the upper-right data extracted through the processing mentioned above. Parenthetically, the number of the averaged data obtained through the processing mentioned above equals to a quarter of the dots of the dot-matrix type LED display device 2 for each color.

The data group as read out is placed at the comparison unit 9, and the counter 8 starts to count the clock signal CK. The count value indicated by the clock signal CK is compared with the position-related averaged data placed at the comparison unit 9. Assuming that the number of the position-related averaged data placed at the comparison unit 9 is "128", the comparison unit 9 then outputs the light emission enable signal for enabling light emission of the LED so long as the count value is smaller than "128" inclusive. On the contrary, when the count value exceeds "128", the comparison unit 9 outputs the light emission inhibit signal for inhibiting the light emission of the LED. In response to the output signal from the comparison unit 9, the light emission driver control unit 10 outputs the light emission driver control signal for controlling the light emission driver circuits 11, 12 and 13 for those LEDs of the 8×8-dot-matrix type LED display device 2 which correspond to the 4×4 position-related averaged data (a group of the upper-right data in this case) shown in FIG. 15B and which are arrayed as shown in FIG. 4B. In response to the light emission driver control signal, the light emission driver circuits 11, 12 and 13 drive the corresponding group of the LEDs of the dot-matrix type LED display device 2. In this case, the array of red, blue and green constituting one dot differs from the array illustrated in FIG. 4A. However, because the color component ratio remains same, the color balance is never disturbed.

Subsequently, the content of the read-out operation counting unit 7 is incremented while the address determining unit 6 determines the address corresponding to the updated content of the read-out operation counting unit 7, whereon the newly determined updated address is outputted to the display data read-out unit 5 which responds thereto by reading out the averaged data stored at the updated address. In this way, it is possible to control the light emission driver circuits 11, 12 and 13 so that the LEDs of the dot-matrix type LED display device 2 are driven in a dot pattern shown in FIG. 4C which corresponds to a group of the lower-left data illustrated in FIG. 15C and then in a dot pattern shown in FIG. 4D which corresponds to a group of the lower-right data illustrated in FIG. 15D, respectively.

A series of the operations described above constitute one cycle. By repeating this cycle a number of times within a same frame, there can be generated such a display as shown in FIG. 16A.

Referring to FIG. 16B, unit-averaged display data shown in this figure are derived by averaging the sixteen data corresponding to one unit of 4×4 dots which in turn have been derived from the display data of 16×16 dots inputted to the display data receiver 3. More specifically, FIG. 16B shows an image displayed by driving the LEDs of the 8×8-dot-matrix type LED display device 2 in conformance with the unit-averaged display data. As can be seen from comparison of FIG. 16A and FIG. 16B, the image displayed on the basis of the unit-averaged data is degraded in respect to the resolution and hence in the image quality.

By virtue of the arrangement of the LED display apparatus according to the instant embodiment of the invention in which the averaged data is generated from the input display data with 2×2 dots (a first predetermined number of dots) thereof being handled as one unit, whereon the averaged data is again grouped into units each including 2×2 dots (a second predetermined number of dots) to be displayed on the dot-matrix type LED display device 2 by changing correspondingly the light emission sequence for the LEDs on a four-dot basis, there can be generated color display with high image quality in a quarter region on the dot-matrix type LED display device 2 notwithstanding of small dot number and low resolution thereof. The image data to be synthesized within one frame in the LED display apparatus according to the instant embodiment are four data, i.e., upper-left data, lower-left data, upper-right data and lower-right data. In this conjunction, it is noted that when the number of the image data to be synthesized or combined increases beyond four, flicker will make appearance even when the number of the cycles to be executed within one frame is increased. Of course, a large number of the images to be synthesized or combined means a correspondingly increased length of one cycle. Consequently, it will be practically impossible to repeat such extended cycle a number of times required for suppressing the flicker.

As is apparent from the foregoing description, with the arrangement of the LED display apparatus according to the present invention in which parts of the input display data of one frame stored in the display data storage unit are read out through a predetermined number of cycles each for one unit including a predetermined number of dots of the input display data within one frame, while the read-out address corresponding to each of the predetermined number of dots in the display data read-out unit is determined in accordance with the number of times the data have been read out, it is possible to process the individual dots within the individual units each constituted by a predetermined number of dots of the input display data. Additionally, the number of LEDs required for the display can be decreased by a factor of the aforementioned predetermined number. In other words, color display of high quality can be generated with a dot-matrix type LED display device of small dot number and low resolution, to an excellent advantage. Furthermore, by providing the display change-over unit for controlling the address determining method for the address determining unit on the basis of the display mode, displays generated on the dot-matrix type LED display device can be changed over on the basis of the display modes, to another great advantage. Furthermore, owing to such arrangement that the display change-over unit samples the display change-over signal indicating the display mode for every frame, the display generated on the dot-matrix type LED display device can be changed by changing over the display mode with the display change-over signal, to a further advantage. Besides, because of provision of the averaging unit for generating the averaged data by averaging the input display data received by the display data receiver for every first predetermined number of dots, it is possible to process the averaged data for every second predetermined number of dots grouped into one unit, while the number of LEDs required for generating the display of image can further be reduced by a factor represented by a product of the first and second predetermined numbers. Thus, by using a portion or section of a screen of the dot-matrix type LED display device of small dot number and low resolution power, a color display of high quality can be generated, to yet another excellent advantage.

As will readily be understood from the foregoing description, the concept of the present invention can equally be implemented as a LED displaying method according to which input display data as received are once stored, wherein parts of the input display data of one frame as stored are read out through a predetermined number of cycles each for one unit composed of a predetermined number of dots of the display data within one frame, while the read-out address for each of the predetermined number of dots is determined in accordance with the number of times the data have been read out. With such LED displaying method, it is possible to process the individual dots within the individual units each constituted by the predetermined number of dots of the input display data. Additionally, the number of LEDs required for the display can be decreased by a factor of the aforementioned predetermined number. Thus, color display of high quality can be generated with a dot-matrix type LED display device of small dot number and low resolution, to an excellently advantageous effect.

What is claimed is:

1. An LED display apparatus, comprising:

(a) an LED panel comprising a number of dots, each of said dots comprising a plurality of neighboring color LEDs, said LEDs being arranged in a repeating regular pattern in said panel;

(b) a display data storage means for storing display data comprising a plurality of data pieces greater in number than said number of dots, said plurality of data pieces being stored in blocks equal in number to said number of dots, each of said blocks being divided into a number of sections;

(c) a pixel data read-out means for reading out from said display data storage means pixel data, comprising a plurality of said data pieces, for all of said dots according to a read-out address signal identifying corresponding ones of said sections within each of said blocks;

(d) a read-out operation counting means for counting a number of said pixel data that said read-out means reads out from said storage means;

(e) an address determining means for providing said read-out address signal to said read-out means, said address determining means changing said address signal to identify a different one of said sections of said blocks in response to an output from said counting means indicating that said number of said pixel data read out by said read-out means is equal to said number of said blocks; and (f) an LED control means for changing a combination of said neighboring LEDs according to said one of said sections identified by said address determining means and driving said combination of said LEDs to display on said panel said pixel data read out by said read-out means.

2. An LED display apparatus according to claim 1, further comprising:

display change-over means for controlling an address determining method to be adopted in said address determining means on the basis of a display mode.

3. An LED display apparatus according to claim 2, wherein said display change-over means samples a display change-over signal indicating a display mode on a frame-by-frame basis.

4. An LED apparatus according to claim 1, wherein said number of dots of said LED panel are arranged in an m×n matrix, said blocks are arranged in an m×n matrix and said plurality of data pieces of said display data are arranged in a p×q matrix, each p×q matrix of said data pieces comprising a frame and said p×q matrix being larger than said m×n matrix.

5. An LED apparatus according to claim 4, wherein said neighboring color LEDs are arranged in a two-by-two matrix comprising one red LED, one blue LED and two green LEDs, and said LED control means energizes different combinations of said red, blue and green LEDs in accordance with different ones of said sections identified by said read-out address signal.

6. An LED apparatus according to claim 4, wherein said sections are arranged in a two-by-two matrix and said read-out address signal identifies locations in said two-by-two matrix, whereby upper-left data, upper-right data, lower-left data and lower-right data are displayed in said m×n matrix of dots in said display panel successively on a time-division basis with a predetermined deviation relative to one another a plurality of times within a same said frame.

7. An LED display apparatus, comprising:

(a) an LED panel comprising a number of dots, each of the dots comprising a plurality of neighboring color LEDs, said LEDs being arranged in a repeating regular pattern in said panel;

(b) averaging means for (i) receiving display data comprising a plurality of data pieces greater in number than said number of dots and (ii) generating averaged data from said data pieces by averaging predetermined combinations of said data pieces;

(c) a display data storage means for storing said averaged data in blocks equal in number to said number of dots, each of said blocks being divided into a number of sections;

(d) a pixel data read-out means for reading out from said storage means pixel data, comprising said averaged data stored in said blocks, for all of said dots according to a read-out address signal identifying corresponding ones of said sections within each of said blocks;

(e) a read-out operation counting means for counting a number of said pixel data that said read-out means reads out from said storage means;

(f) an address determining means for providing said read-out address signal to said read-out means, said address determining means changing said address signal to identify a different one of said sections of said blocks in response to an output from said counting means indicating that said number of said pixel data read out by said read-out means is equal to said number of said blocks; and (g) an LED control means for changing a combination of said neighboring LEDs according to said identified one of said sections and driving said combination of said LEDs to display on said panel said pixel data read out by said read-out means.

8. An LED apparatus according to claim 7, wherein said number of dots of said LED panel are arranged in an m×n matrix, said blocks are arranged in an m×n matrix and said plurality of data pieces of said display data are arranged in a p×q matrix, each p×q matrix of said data pieces comprising a frame and said p×q matrix being larger than said m×n matrix.

9. An LED apparatus according to claim 8, wherein said neighboring color LEDs are arranged in a two-by-two matrix comprising one red LED, one blue LED and two green LEDs, and said LED control means energizes different combinations of said red, blue and green LEDs in accordance with different ones of said sections identified by said read-out address signal.

10. A method of displaying display data on a dot-matrix type LED display device including an LED panel comprising a number of dots, each of said dots comprising a plurality of neighboring color LEDs, said LEDs being arranged in a repeating regular pattern in said panel, said display data comprising a plurality of data pieces greater in number than said number of dots, said method comprising:

(a) storing in a storage means said display data such that said plurality of data pieces are stored in blocks equal in number to said number of dots, and dividing each of said blocks into a number of sections;

(b) reading out from said storage means pixel data, comprising a plurality of said data pieces of said display data, for all of said dots according to a read-out address signal identifying corresponding ones of said sections within each of said blocks;

(c) counting a number of said pixel data that are read out from said storage means in step (b);

(d) changing said address signal to identify a different one of said sections of said blocks in response to a determination in step (c) that said number of said pixel data read out is equal to said number of said blocks; and (e) changing a combination of said neighboring LEDs according to said one of said sections identified in step (d) and driving said combination of said LEDs to display on said panel said pixel data read out in step (b).

11. A method according to claim 10, wherein said sections are arranged in a two-by-two matrix and said read-out address signal identifies locations in said two-by-two matrix, whereby upper-left data, upper-right data, lower-left data and lower-right data are displayed in said m×n matrix of dots in said display panel successively on a time-division basis with a predetermined deviation relative to one another a plurality of times within a same said frame.

12. A method of displaying display data on a dot-matrix type LED display device including an LED panel comprising a number of dots, each of said dots comprising a plurality of neighboring color LEDs, said LEDs being arranged in a repeating regular pattern in said panel, said display data comprising a plurality of data pieces greater in number than said number of dots, said method comprising:

(a) generating averaged data from said data pieces by averaging predetermined combinations of said data pieces of said display data;

(b) storing in a storage means said averaged data in blocks equal in number to said number of dots, and dividing each of said blocks into a number of sections;

(c) reading out from said storage means pixel data, comprising said averaged data stored in said blocks, for all of said dots according to a read-out address signal identifying corresponding ones of said sections within each of said blocks;

(d) counting a number of said pixel data read out from said storage means in step (c);

(e) changing said address signal to identify a different one of said sections of said blocks in response to a determination in step (d) that said number of said pixel data read out is equal to said number of said blocks; and (f) changing a combination of said neighboring LEDs according to said one of said sections identified in step (e) and driving said combination of said LEDs to display on said panel said pixel data read out in step (c).

* * * * *